US005270073A

United States Patent [19]

Koshizuka et al.

[11] Patent Number: 5,270,073

[45] Date of Patent: Dec. 14, 1993

[54] HEAT SENSITIVE RECORDING MATERIAL, ITS MANUFACTURING METHOD AND IMAGE FORMING PROCESS

[75] Inventors: Kunihiro Koshizuka; Takao Abe, both of Hino, Japan

[73] Assignee: Konica Corporation, Tokyo, Japan

[21] Appl. No.: 830,486

[22] Filed: Feb. 4, 1992

Related U.S. Application Data

[63] Continuation of Ser. No. 444,627, Dec. 1, 1989, abandoned.

[30] Foreign Application Priority Data

| | | | |
|---|---|---|---|
| Dec. 2, 1988 | [JP] | Japan | 63-305187 |
| Dec. 2, 1988 | [JP] | Japan | 63-305311 |
| Dec. 6, 1988 | [JP] | Japan | 63-308596 |
| Apr. 6, 1989 | [JP] | Japan | 1-87723 |

[51] Int. Cl.[5] ..... B41M 3/12

[52] U.S. Cl. ..... 427/146; 417/407.1; 417/411; 417/412.1

[58] Field of Search ..... 427/151, 152, 150, 146, 427/385.5, 407.1, 411, 412.1

[56] References Cited

U.S. PATENT DOCUMENTS

| | | | |
|---|---|---|---|
| 3,924,041 | 12/1975 | Miyama et al. | 427/152 |
| 4,228,222 | 10/1980 | Murakami et al. | 427/150 |
| 4,529,993 | 7/1985 | Watanabe et al. | 427/151 |
| 4,923,845 | 5/1990 | Koike et al. | 427/152 |

FOREIGN PATENT DOCUMENTS

| | | |
|---|---|---|
| 249195 | 12/1987 | European Pat. Off. . |
| 0249195 | 12/1987 | European Pat. Off. . |
| 4811409 | 4/1973 | Japan . |
| 62-280084 | 12/1987 | Japan . |
| 6387865 | 10/1989 | Japan . |
| 2044473 | 10/1980 | United Kingdom . |

OTHER PUBLICATIONS

Patent Abstracts of Japan, vol. 12, No. 164 (M-698) (3011); May 18, 1988 JPA-62-280084; Dec. 4, 1987.

Patent Abstracts of Japan, vol. 14, No. 13 (M-918) (3956); Jan. 11, 1990 JPA-01-258989; Oct. 16, 1989.

*Primary Examiner*—Janyce Bell

*Attorney, Agent, or Firm*—Jordan B. Bierman

[57] ABSTRACT

A heat sensitive recording material is disclosed. The material comprises an image receiving layer and a colorant layer, wherein the image receiving layer is adhered to the colorant layer so firmly that the image receiving layer can be separated from the colorant layer with a peeling force of 1 to 1000 g/mm at an angle of 180° after forming an image on the image receiving layer.

33 Claims, 16 Drawing Sheets

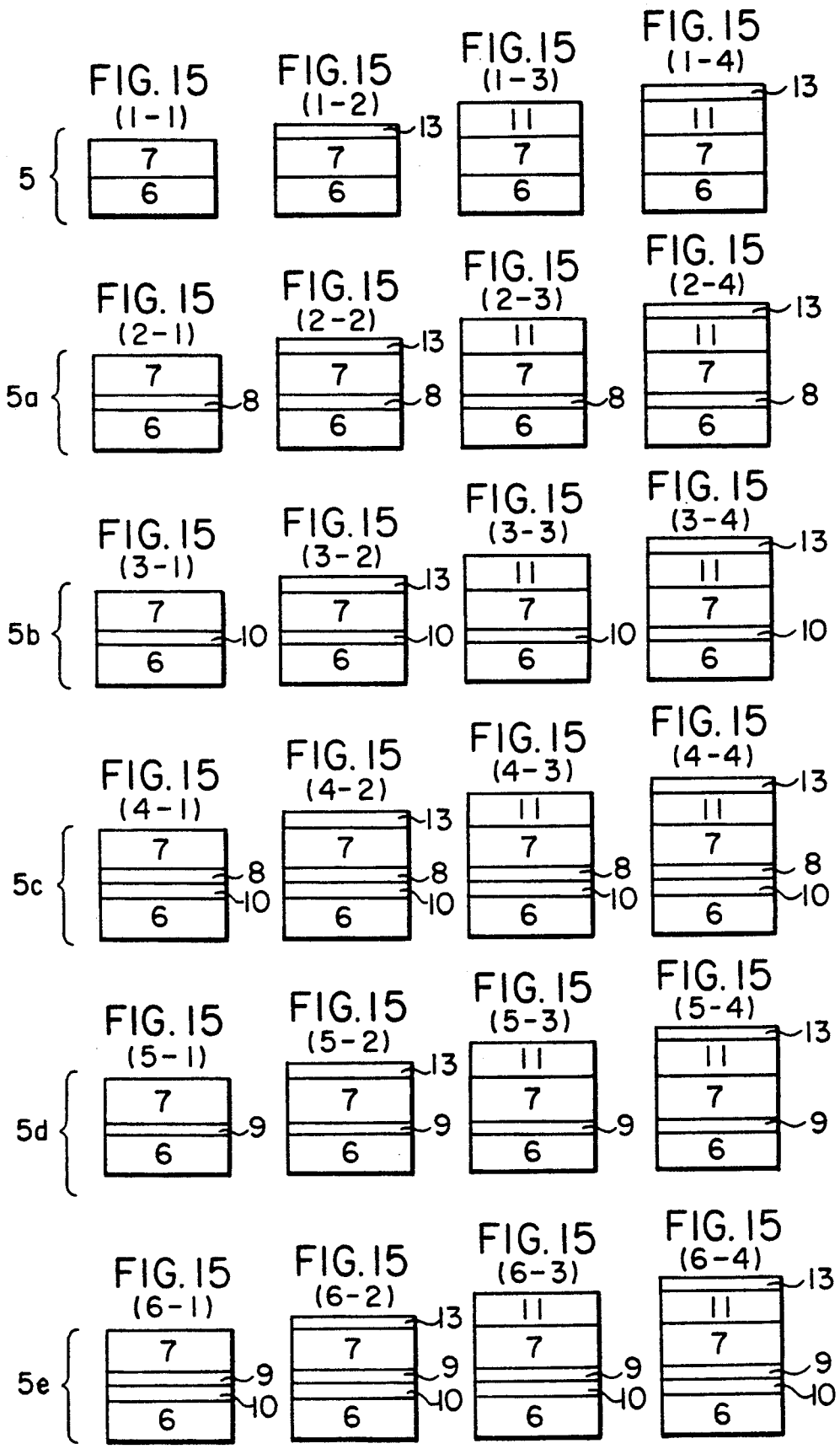
FIG. 15 (1-1)
FIG. 15 (1-2)
FIG. 15 (1-3)
FIG. 15 (1-4)
5
FIG. 15 (2-1)
FIG. 15 (2-2)
FIG. 15 (2-3)
FIG. 15 (2-4)
5a
FIG. 15 (3-1)
FIG. 15 (3-2)
FIG. 15 (3-3)
FIG. 15 (3-4)
5b
FIG. 15 (4-1)
FIG. 15 (4-2)
FIG. 15 (4-3)
FIG. 15 (4-4)
5c
FIG. 15 (5-1)
FIG. 15 (5-2)
FIG. 15 (5-3)
FIG. 15 (5-4)
5d
FIG. 15 (6-1)
FIG. 15 (6-2)
FIG. 15 (6-3)
FIG. 15 (6-4)
5e
6
7
8
9
10
11
13

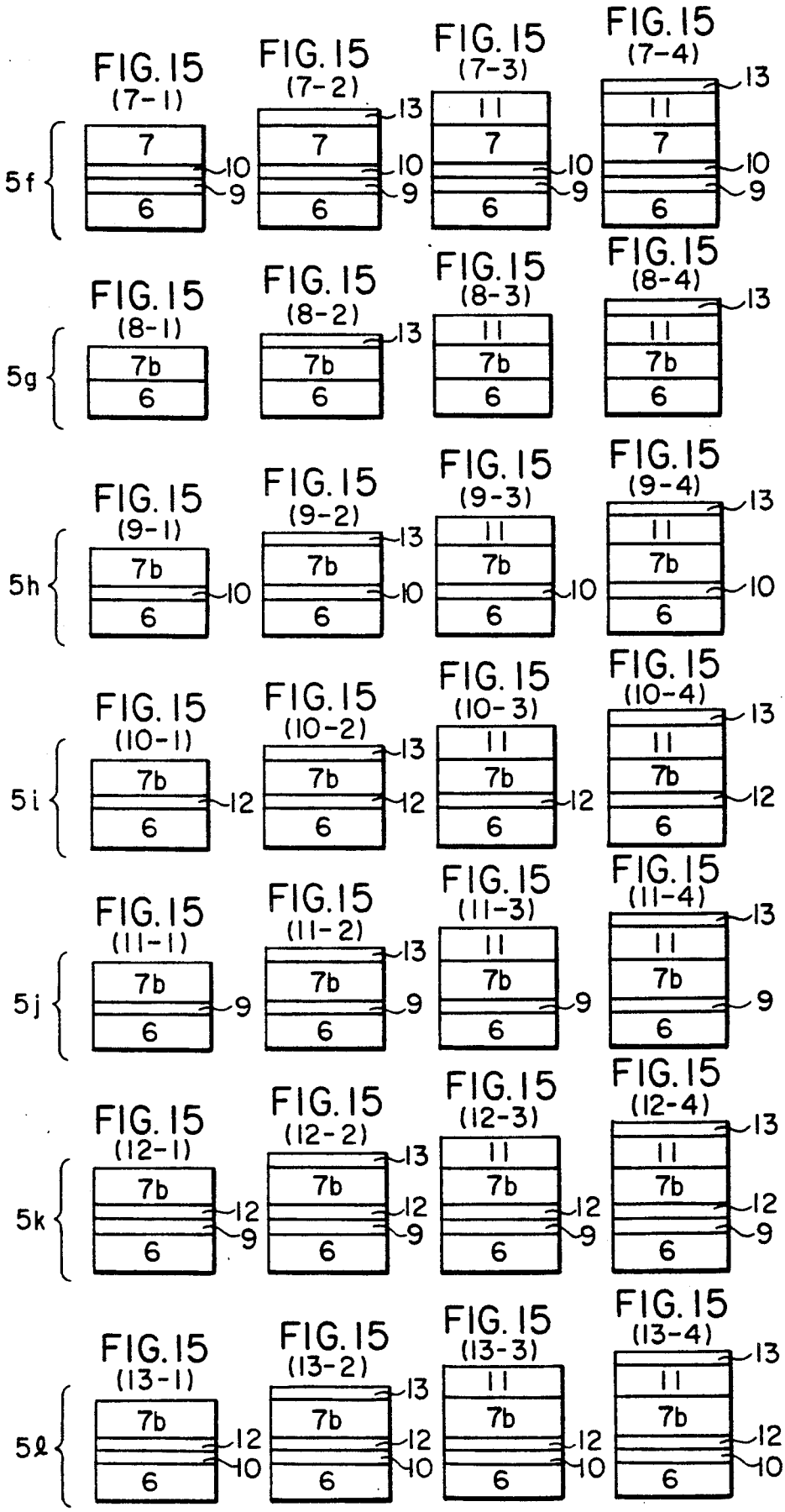
FIG. 15 (7-1)
FIG. 15 (7-2)
FIG. 15 (7-3)
FIG. 15 (7-4)
5f
7
6
11
13
10
9
FIG. 15 (8-1)
FIG. 15 (8-2)
FIG. 15 (8-3)
FIG. 15 (8-4)
5g
7b
FIG. 15 (9-1)
FIG. 15 (9-2)
FIG. 15 (9-3)
FIG. 15 (9-4)
5h
FIG. 15 (10-1)
FIG. 15 (10-2)
FIG. 15 (10-3)
FIG. 15 (10-4)
5i
12
FIG. 15 (11-1)
FIG. 15 (11-2)
FIG. 15 (11-3)
FIG. 15 (11-4)
5j
FIG. 15 (12-1)
FIG. 15 (12-2)
FIG. 15 (12-3)
FIG. 15 (12-4)
5k
FIG. 15 (13-1)
FIG. 15 (13-2)
FIG. 15 (13-3)
FIG. 15 (13-4)
5ℓ

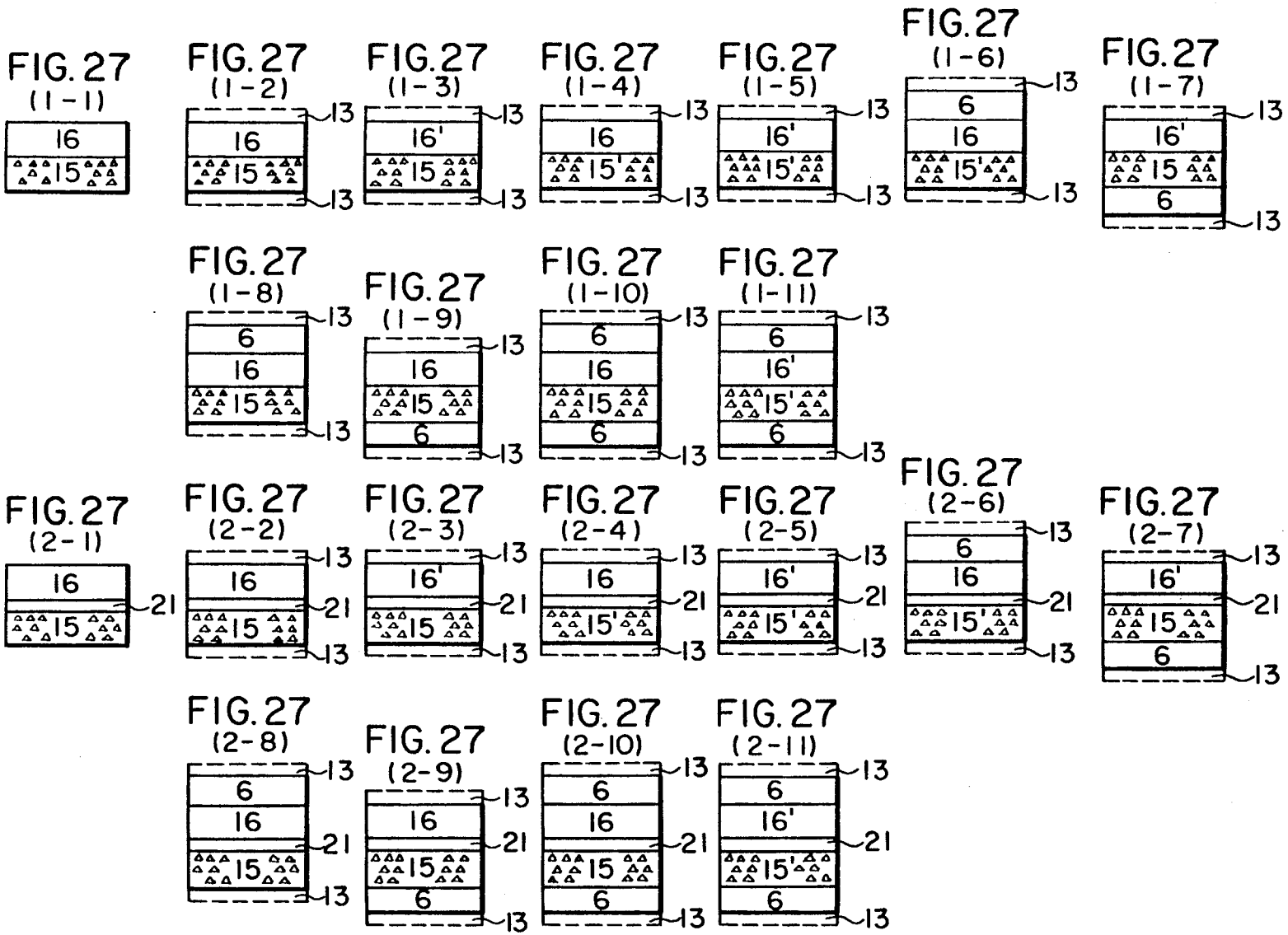
FIG. 27 (1-1)
FIG. 27 (1-2)
FIG. 27 (1-3)
FIG. 27 (1-4)
FIG. 27 (1-5)
FIG. 27 (1-6)
FIG. 27 (1-7)
FIG. 27 (1-8)
FIG. 27 (1-9)
FIG. 27 (1-10)
FIG. 27 (1-11)
FIG. 27 (2-1)
FIG. 27 (2-2)
FIG. 27 (2-3)
FIG. 27 (2-4)
FIG. 27 (2-5)
FIG. 27 (2-6)
FIG. 27 (2-7)
FIG. 27 (2-8)
FIG. 27 (2-9)
FIG. 27 (2-10)
FIG. 27 (2-11)
16
16'
15
15'
6
13
21

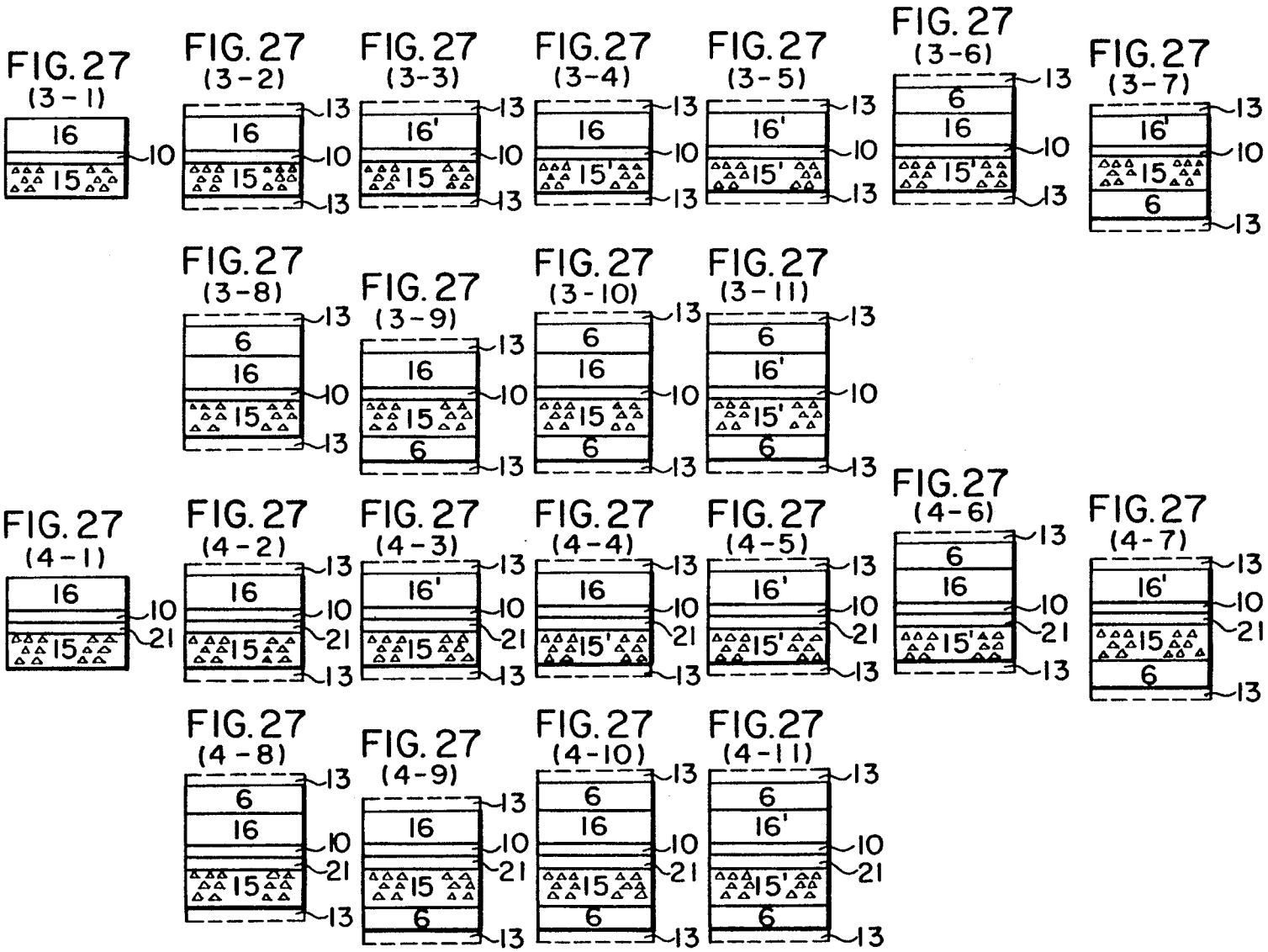
FIG. 27 (3-1)
FIG. 27 (3-2)
FIG. 27 (3-3)
FIG. 27 (3-4)
FIG. 27 (3-5)
FIG. 27 (3-6)
FIG. 27 (3-7)
FIG. 27 (3-8)
FIG. 27 (3-9)
FIG. 27 (3-10)
FIG. 27 (3-11)
FIG. 27 (4-1)
FIG. 27 (4-2)
FIG. 27 (4-3)
FIG. 27 (4-4)
FIG. 27 (4-5)
FIG. 27 (4-6)
FIG. 27 (4-7)
FIG. 27 (4-8)
FIG. 27 (4-9)
FIG. 27 (4-10)
FIG. 27 (4-11)
16
16'
15
15'
6
10
13
21

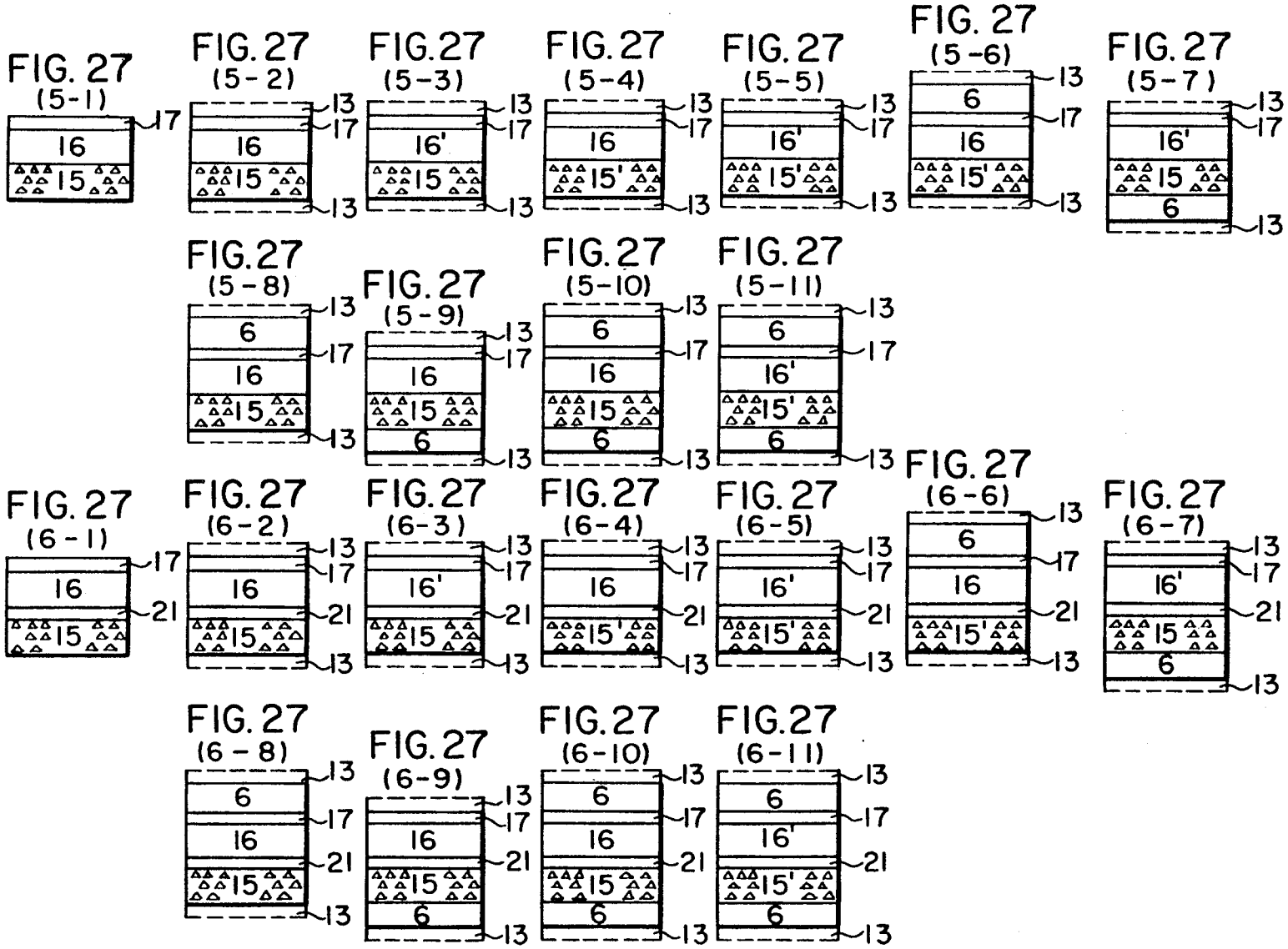
FIG. 27 (5-1)
FIG. 27 (5-2)
FIG. 27 (5-3)
FIG. 27 (5-4)
FIG. 27 (5-5)
FIG. 27 (5-6)
FIG. 27 (5-7)
FIG. 27 (5-8)
FIG. 27 (5-9)
FIG. 27 (5-10)
FIG. 27 (5-11)
FIG. 27 (6-1)
FIG. 27 (6-2)
FIG. 27 (6-3)
FIG. 27 (6-4)
FIG. 27 (6-5)
FIG. 27 (6-6)
FIG. 27 (6-7)
FIG. 27 (6-8)
FIG. 27 (6-9)
FIG. 27 (6-10)
FIG. 27 (6-11)
16
16'
15
15'
6
13
17
21

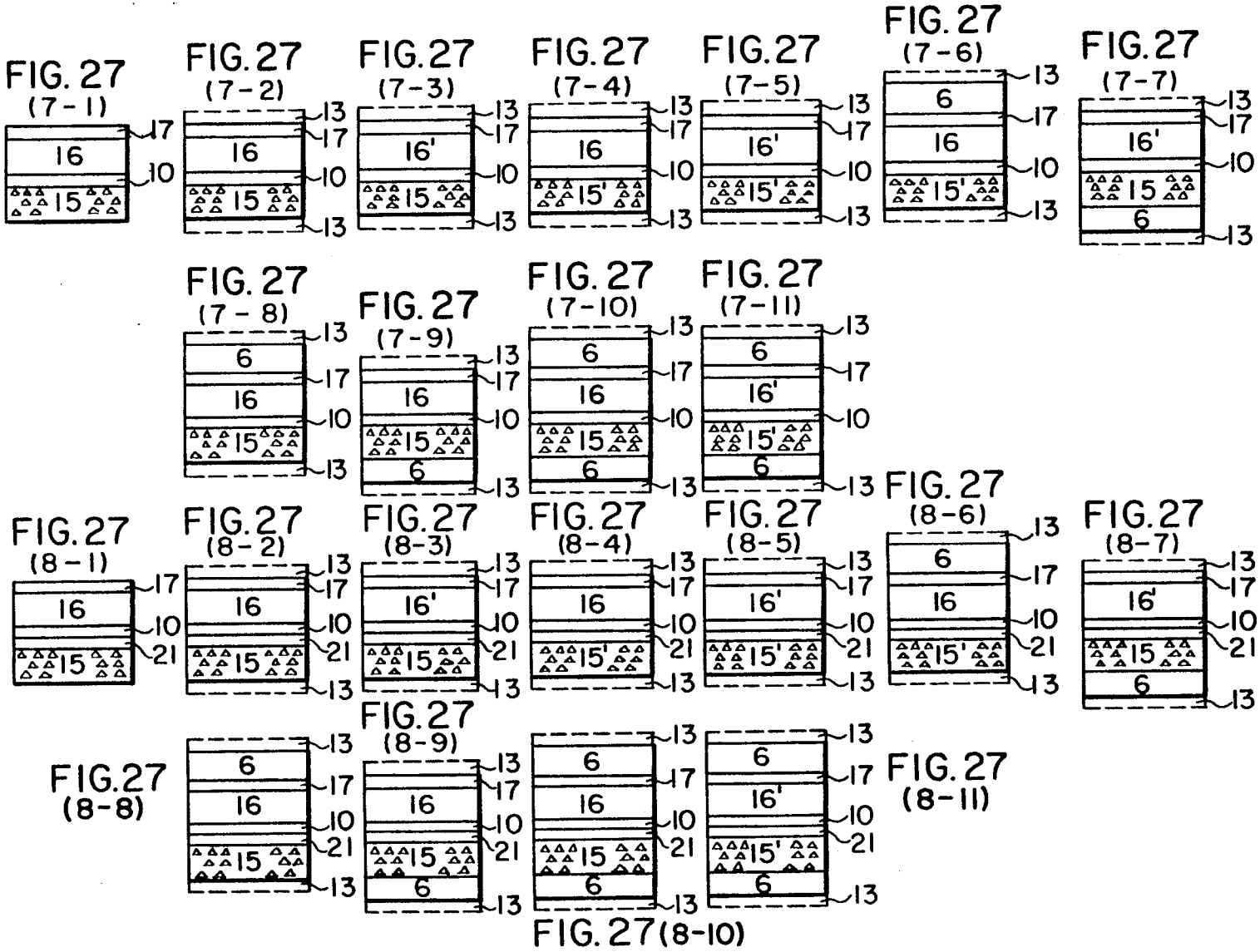
FIG. 27 (7-1)
FIG. 27 (7-2)
FIG. 27 (7-3)
FIG. 27 (7-4)
FIG. 27 (7-5)
FIG. 27 (7-6)
FIG. 27 (7-7)
FIG. 27 (7-8)
FIG. 27 (7-9)
FIG. 27 (7-10)
FIG. 27 (7-11)
FIG. 27 (8-1)
FIG. 27 (8-2)
FIG. 27 (8-3)
FIG. 27 (8-4)
FIG. 27 (8-5)
FIG. 27 (8-6)
FIG. 27 (8-7)
FIG. 27 (8-8)
FIG. 27 (8-9)
FIG. 27 (8-10)
FIG. 27 (8-11)

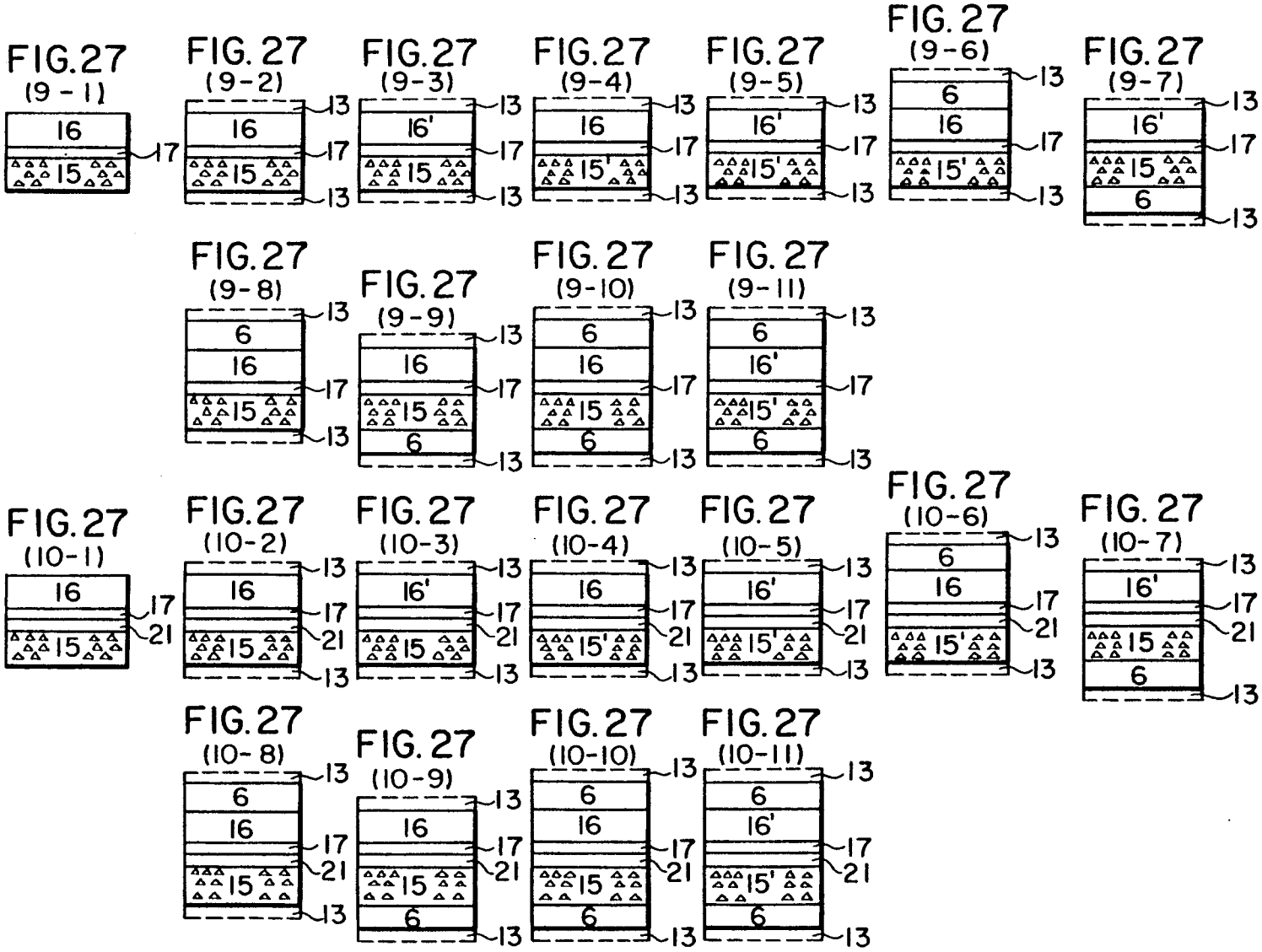
FIG. 27 (9-1)
FIG. 27 (9-2)
FIG. 27 (9-3)
FIG. 27 (9-4)
FIG. 27 (9-5)
FIG. 27 (9-6)
FIG. 27 (9-7)
FIG. 27 (9-8)
FIG. 27 (9-9)
FIG. 27 (9-10)
FIG. 27 (9-11)
FIG. 27 (10-1)
FIG. 27 (10-2)
FIG. 27 (10-3)
FIG. 27 (10-4)
FIG. 27 (10-5)
FIG. 27 (10-6)
FIG. 27 (10-7)
FIG. 27 (10-8)
FIG. 27 (10-9)
FIG. 27 (10-10)
FIG. 27 (10-11)
16
16'
15
15'
6
13
17
21

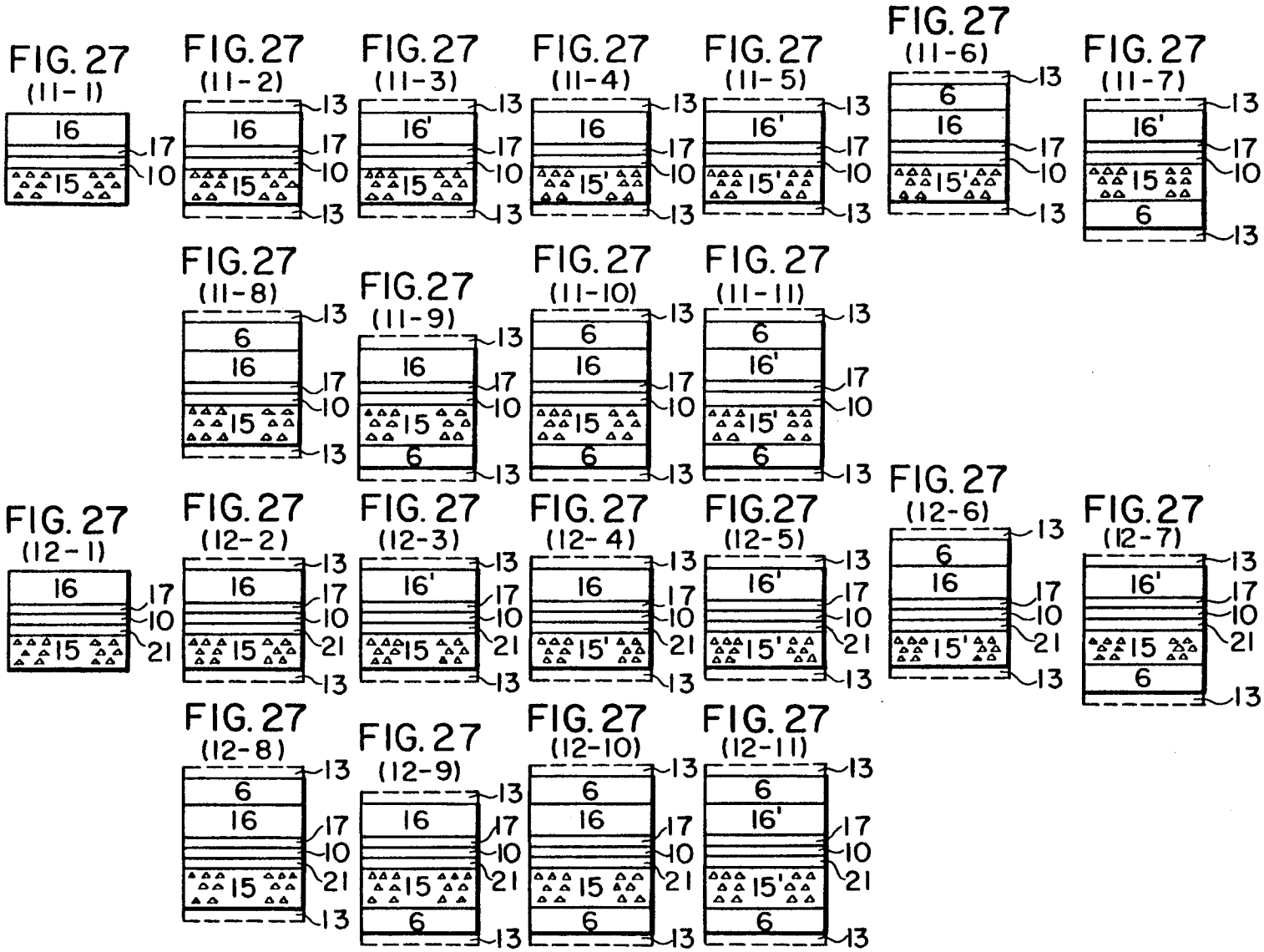
FIG. 27 (11-1)
FIG. 27 (11-2)
FIG. 27 (11-3)
FIG. 27 (11-4)
FIG. 27 (11-5)
FIG. 27 (11-6)
FIG. 27 (11-7)
FIG. 27 (11-8)
FIG. 27 (11-9)
FIG. 27 (11-10)
FIG. 27 (11-11)
FIG. 27 (12-1)
FIG. 27 (12-2)
FIG. 27 (12-3)
FIG. 27 (12-4)
FIG. 27 (12-5)
FIG. 27 (12-6)
FIG. 27 (12-7)
FIG. 27 (12-8)
FIG. 27 (12-9)
FIG. 27 (12-10)
FIG. 27 (12-11)
16
16'
15
15'
6
10
13
17
21

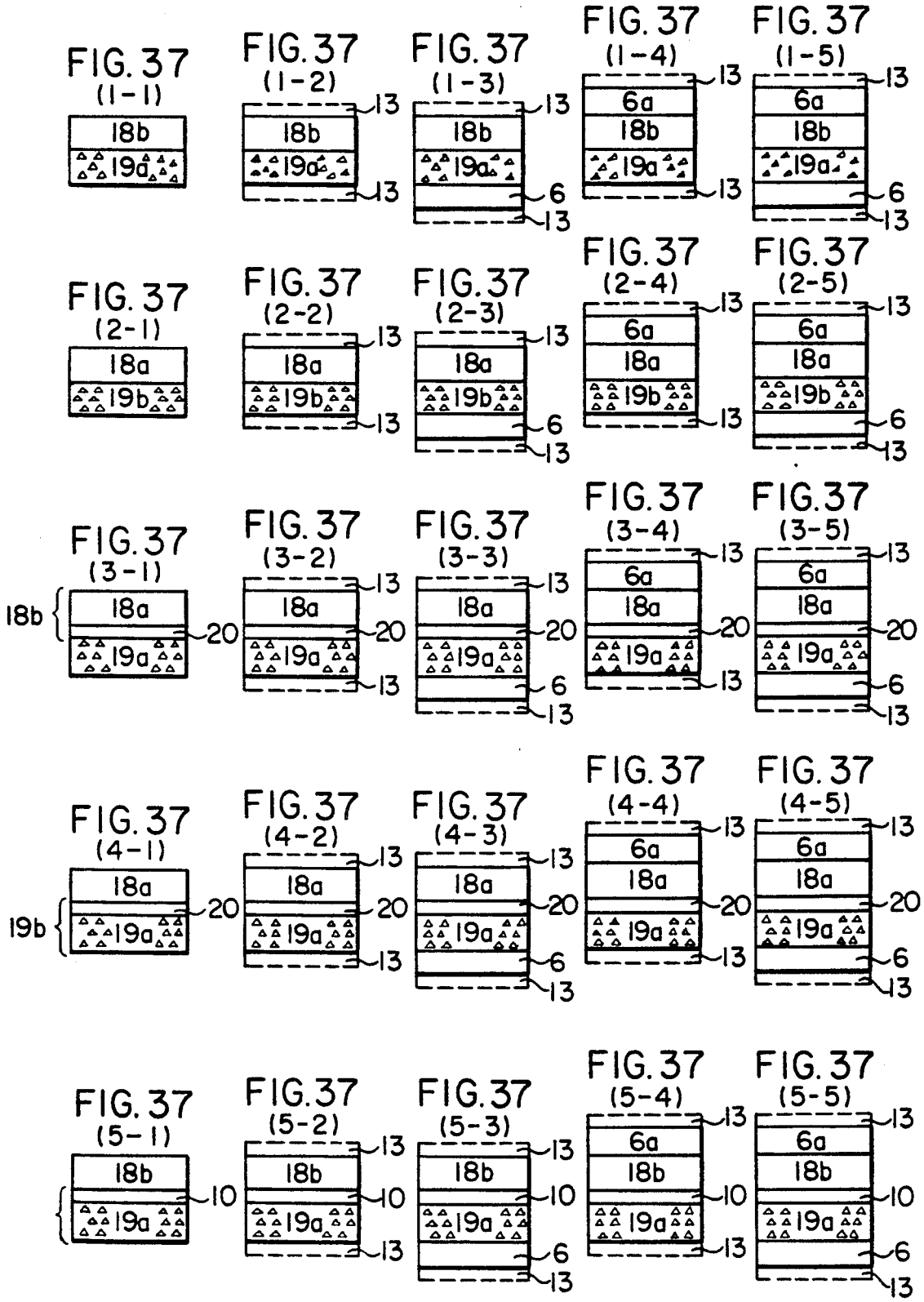
FIG. 37 (1-1)
18b
19a
FIG. 37 (1-2)
13
18b
19a
13
FIG. 37 (1-3)
13
18b
19a
6
13
FIG. 37 (1-4)
13
6a
18b
19a
13
FIG. 37 (1-5)
13
6a
18b
19a
6
13
FIG. 37 (2-1)
18a
19b
FIG. 37 (2-2)
13
18a
19b
13
FIG. 37 (2-3)
13
18a
19b
6
13
FIG. 37 (2-4)
13
6a
18a
19b
13
FIG. 37 (2-5)
13
6a
18a
19b
6
13
FIG. 37 (3-1)
18b
18a
20
19a
FIG. 37 (3-2)
13
18a
20
19a
13
FIG. 37 (3-3)
13
18a
20
19a
6
13
FIG. 37 (3-4)
13
6a
18a
20
19a
13
FIG. 37 (3-5)
13
6a
18a
20
19a
6
13
FIG. 37 (4-1)
19b
18a
20
19a
FIG. 37 (4-2)
13
18a
20
19a
13
FIG. 37 (4-3)
13
18a
20
19a
6
13
FIG. 37 (4-4)
13
6a
18a
20
19a
13
FIG. 37 (4-5)
13
6a
18a
20
19a
6
13
FIG. 37 (5-1)
18b
10
19a
FIG. 37 (5-2)
13
18b
10
19a
13
FIG. 37 (5-3)
13
18b
10
19a
6
13
FIG. 37 (5-4)
13
6a
18b
10
19a
13
FIG. 37 (5-5)
13
6a
18b
10
19a
6
13

FIG. 37 (6-1)
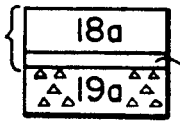
FIG. 37 (6-2)
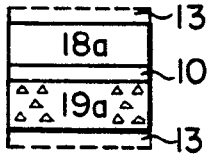
FIG. 37 (6-3)
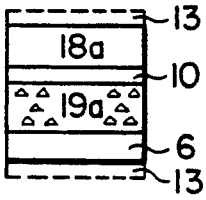
FIG. 37 (6-4)
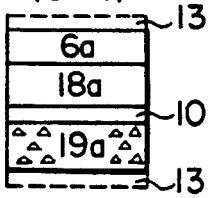
FIG. 37 (6-5)
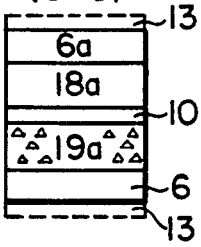
FIG. 37 (7-1)
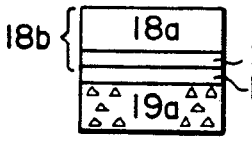
FIG. 37 (7-2)
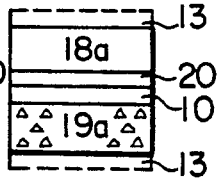
FIG. 37 (7-3)
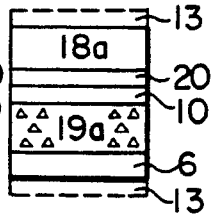
FIG. 37 (7-4)
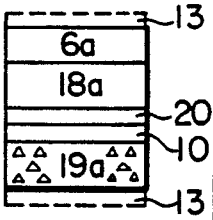
FIG. 37 (7-5)
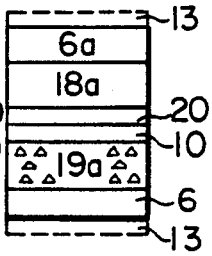
FIG. 37 (8-1)
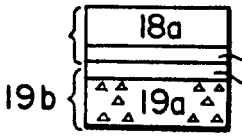
FIG. 37 (8-2)
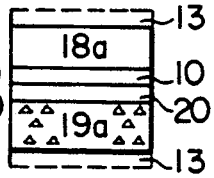
FIG. 37 (8-3)
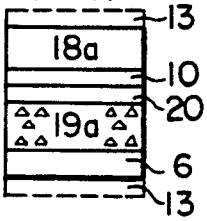
FIG. 37 (8-4)
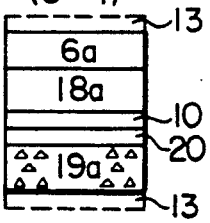
FIG. 37 (8-5)
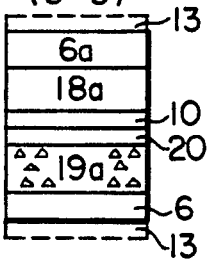

HEAT SENSITIVE RECORDING MATERIAL, ITS MANUFACTURING METHOD AND IMAGE FORMING PROCESS

This application is a continuation of application Ser. No. 07/444,627, filed Dec. 1, 1989, now abandoned.

FIELD OF THE INVENTION

This invention relates to a heat-sensitive recording material and, more particularly, to a heat-sensitive recording material capable of forming an excellently long-lasting printed-image, stably, simply, efficiently, and inexpensively.

BACKGROUND OF THE INVENTION

In recent years, a heat-sensitive color-developing paper has come into wide use, as a heat-sensitive recording material for a facscimile.

Such a heat-sensitive color-developing paper as mentioned above usually forms a printed-image thereon in the manner that the paper surface is so heated as to color-develop the heated portion thereof.

The above-described heat-sensitive color-developing papers have had the problems so far that the surface thereof is liable to be discolored by the change on standing after an image is printed and, in particular, that the storage-stability of a printed-image has been deteriorated, for example, the portion other than the printed portion has also been color-developed as same as in the printed portion, when the portion other than the printed portion has been exposed repeatedly to heat or light.

On the other hand, a heat-sensitive transfer-paper has been proposed to serve as a heat-sensitive material having an excellent storage-stability.

Ordinarily, such a heat-sensitive transfer paper comprises the two components, namely, an image-tranfer-recipient paper and a heat-transfer member, each arranged independently. In this ordinary case, the two components are stored in a rolled form, laid one upon another or separated one from another. When using this type of heat-sensitive transfer-paper, a printed-image may be formed on the transfer-image-recipient paper in such a manner that a colorant containing layer of the heat-transfer member is heated to fuse and the heat-transfer member is then brought into pressure-contact with the tansfer-image recipient paper, so that an image in the portion to be transferred may be transferred to the image-recipient paper.

Such a heat-sensitive transfer-paper, different from heat-sensitive color-paper, requires two composing materials (transfer recipient paper and heat transfer material) in order to get a recording paper having printed images. Therefore, it has such problems as that, for example, control and check must be needed for both of transfer recipient paper and heat transfer material, as the heat-transfer material is composed of support and a colorant containing layer and the foregoing support becomes completely useless after being printed so that the cost of heat transfer material is expensive, as originally the transfer recipient paper and the heat transfer material are separated and the heat transfer material is a thin sheet so that wrinkles are easy to be made on transfer recipier paper and heat transfer material when printing is done while rolled heat-sensitive transfer paper is wound therefore it is liable that printing order goes out of order, troubles occur in winding operation of heat-sensitive transfer paper or running of heat-sensitive transfer paper cannot be done stably.

As a commonly-used heat-sensitive recording material, an ink ribbon having a thermosoftening colorant containing layer on a support is used. In the case of this ink ribbon, the foregoing ink ribbon is contacted to the transfer recipient material, for example paper, and heat is applied imagewisely so that a heat-fusing thermosoftening colorant layer is transfered onto a recording material to form a printing image thereon.

In this ink ribbon, too, the support becomes useless after being printed. Therefore, the cost of the ink ribbon is expensive.

Besides, on the other hand, the foregoing heat-sensitive transfer paper or the foregoing heat-sensitive color-developing paper are used as barcode use or label use. In these case, not only image preservation but also abrasion resistance becomes problem. If the foregoing heat-sensitive transfer paper is used, abrasion resistance is bad, and if the foregoing heat-sensitive color-developing paper is used, both of image preservation and abrasion resistance are bad.

SUMMARY OF THE INVENTION

The present invention was designed on the former situations.

Namely, the object of the invention is to provide inexpensive heat-sensitive recording material wherein preservation-storability of printing image is good, printing can be done simply and effectively, a multi-color image and an image having a different gradation can be formed and it can be used for a label.

BRIEF DESCRIPTION OF THE DRAWINGS

FIG. 15 is an illustration of the first embodiment;

FIG. 27 is an illustration of the second embodiment;

FIG. 37 is an illustration of the third embodiment; wherein

1 . . . Image-receiving layer; 2 . . . Colorant layer; 5 . . . Heat-sensitive material; 6 . . . Support; 6a . . . Transparent support; 7 . . . Thermosoftening colorant layer; 7b . . . Special thermosoftening colorant layer; 8 . . .

Sublayer; 9 . . . Thermosoftening layer; 10 . . . Peeling layer; 11 . . . Peeling-supporting layer; 12 . Antifogging layer; 13 . . . Anti-sticking layer; 14 . . . Dye; 15 . . . Dye-supplying layer; 16 . . . Mordant layer; 17 . . . Sublayer for masking; 18 . . . Sticky mordant layer; 18a . . . Non-sticky mordant layer; **18*b* . . . Sticky mordant layer; 20 . . . Sticky layer; 19a . . . Non-sticky dye-supptying layer; 19b . . . Sticky dye-supplying layer; and 21** . . . Antifogging layer

DETAILED DESCRIPTION OF THE INVENTION

A heat sensitive recording material of the invention for dissolving the foregoing problems is a heat sensitive recording material comprising an image receiving layer and a colorant layer where the image receiving layer is adhered to the colorant layer so firmly that the image receiving layer can be separated from the colorant layer with a peeling force of 0.1 to 1000 g/mm at an angle of 180° after forming an image on the image receiving layer.

Figure 1:
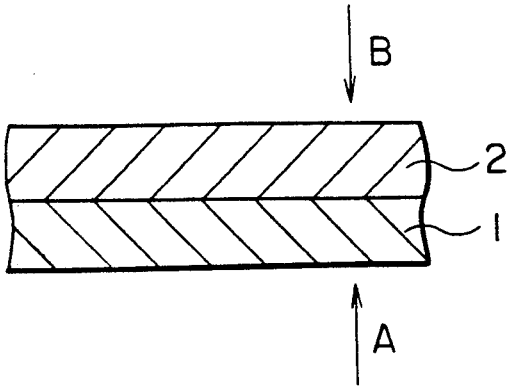
FIGS. 1, 2, 3, 4, 5 and 6 are each the illustrations on the principle applied to the invention.

In the invention, as shown in FIG. 1, generally speaking, image is formed on the foregoing image receiving layer in the heat-sensitive recording material comprising the foregoing image receiving layer 1 and colorant containing layer 2.

Figure 2:
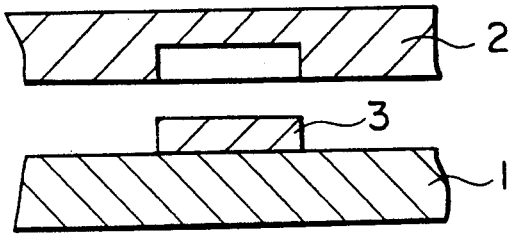

Namely, in this image forming mechanism, when heat is added image-wisely to the surface of the image receiving layer 1 not contacting the colorant containing layer 2 (in FIG. 1, heat is added from arrow mark direction A), or when heat is added image-wisely to the colorant containing layer 2 not contacting the image receiving layer 1 (in FIG. 2, heat is added from arrow mark direction B). stronger adhesive power is generated to the heating part in the foregoing colorant containing layer 2 against the image receiving layer I. Then, when the colorant containing layer 2 is detached from the image receiving layer 1, the colorant containing layer 2 to be heated is coagulated and broken as shown in FIG. 2, or it is surfactantly destroyed. As a result, colorant containing part 3 separated from the detached colorant containing layer 2 remains on the colorant containing part 3. The image receiving layer 1 having this image is utilized as an image recording body.

Figure 4:
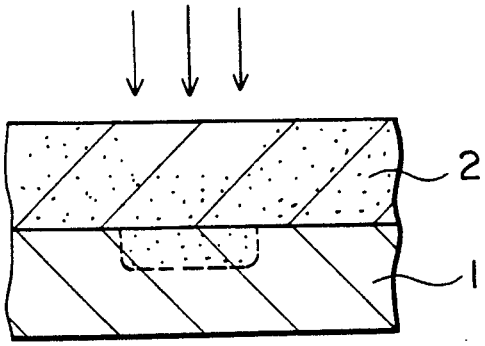
Figure 5:
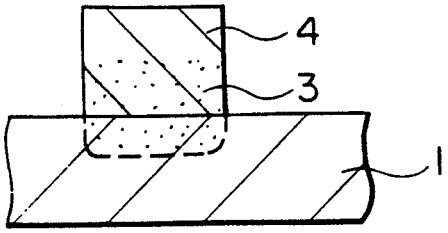

On the other hand, as shown in FIG. 4, in case that the heat moving speed of colorant in the colorant containing layer 2 is big, when heat is added image-wisely, the colorant of the colorant containing layer 2 is heat-shifted with a binder to the heat image receiving layer 1 side, and in the colorant containing layer 2, the colorant near the surface of the colorant containing layer Z is moved to the image receiving layer 1 side. As a result, in the colorant containing part 3 remaining on the image receiving layer 1 after the colorant containing layer 2 is detached, as shown in FIG. 5, an image receiving layer 1 wherein colorant containing layer 2 having no or little colorant containing amount on its surface part 4. An image formed on the image receiving layer 1 like this does not have a colorant on the surface part. So, even if the image surface is lost more or less by the outer power, the image itself does not receive damage. And as the colorant and uniting material invade into the image receiving layer 1, the colorant containing layer 2 does not detach from the image receiving layer 1. Namely, The image receiving layer 1 having an excellent image in abrasion resistance is used as an image recording body.

In another image forming mechanism, the heat recording material of the invention is the material where an image receiving layer 1 is superimposed on a colorant layer 2 comprising a colorant 3 diffusable by heat energy and a binder.

Figure 6:
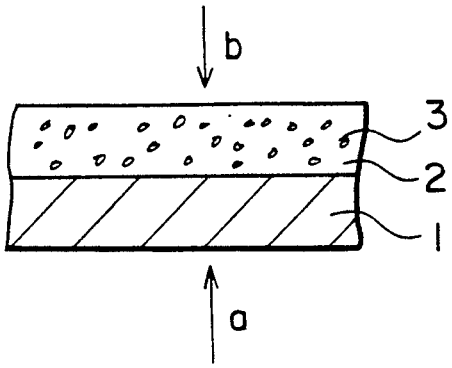

And when heat is added image-wisely to the surface of the image receiving layer 1 not contacting the colorant containing layer 2 (in FIG. 6, heat is added from arrow mark direction a), or when heat is added image-wisely to the colorant containing layer 2 not contacting the image receiving layer 1 (in FIG. 6, heat is added from arrow mark direction b), stronger adhesive power is generated to the heating part in the foregoing colorant containing layer 2, at the same time, colorant in the colorant containing layer is difused and moved into the image receiving layer 1. And when the image material containing layer 2 is peeled off the image receiving layer 1, an image receiving layer 1, image receiving layer 1 can be obtained so as to have an image formed thereon by transferring a colorant i.e., a dye, with a heat-diffusion, from heat-applied colorant-containing layer 2 into image-receiving layer 1. An image receiving layer having this image can be used as an image recording body. Besides, when the colorant containing layer is peeled off from the image receiving layer, in case that colorant containing layer is coagulated and destroyed, a part of colorant containing layer remains on the surface of image receiving layer having an image. So, the remaining colorant containing layer has a role of protective layer so that an image excellent in abrasion resistance can be formed.

Heat-sensitive recording material in the invention is not limited to the double-layer structure composed of the foregoing image receiving layer and colorant containing layer so that various kinds of layer structures can be adopted within the range that they do not interfere the objects of the invention. For example, heat-sensitive recording material of the invention can also have such an appropriate layer arrangement as is comprised of an anti-sticking layer, a peeling-off layer, a supporting layer for peeling-off, a supporting layer, an adhesion layer, and an antifogging layer.

The heat sensitive recording material of the invention is a heat sensitive recording material where an image receiving layer is adhered directly or indirectly to a colorant layer so firmly that the image receiving layer can be separated from the colorant layer with a peeling force of 0.1 to 1000 g/mm at an angle of 180° after forming an image on the image receiving layer. The heat sensitive recording material of the invention excludes a heat sensitive recording material where an image receiving layer is simply superposed directly or indirectly onto a colorant layer. The peeling force is measured by the method as described in JIS 6854.

Now, an appropriate embodiment of the invention will be detailed below.

The first embodiment

The first appropriate embodiment of the invention is the foregoing heat-sensitive recording material wherein the foregoing image receiving layer is a support and the foregoing colorant containing layer is a thermosoftening colorant layer.

(1) Basic structure

Figure 7:
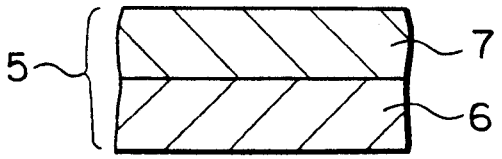
FIG. 7 is a cross-sectional illustration of one of the embodiments of the invention.

As shown in FIG. 7, heat-sensitive recording material 5 having the basic structure of the first embodiment is formed by piling a thermosoftening coloring layer 7 as a colorant containing layer on the support 6.

The foregoing support is preferable to have a good heat resistance and dimensional stability.

As the materials of the support; papers such as plain paper, condenser paper, laminated paper, and coated paper; resin films such as those made of polyethylene. polyethyleneterephthalate, polystylene, polypropyrene, or polyimide; composite materials of paper and resin film; and metal sheets such as that made of an alminium foil.

Such supports are used as an recording member supporting an image, so that it may be necessary to have an enough self-supportability. In order to satisfy it, the thicknesses of the supports are to be regulated to not more than 500 μm. for example, and, preferably, within the range of 1 to 200 μm. If the thickness of such a support is less than 1 μm, there may be a possibility to lose the self-supportability of the support.

The forms of the supports can be so suitably determined as to meet the purposes of the heat-sensitive recording material they can be taken in any desirable forms of, for example, a tape, a sheet, and a label.

Between the support and the thermosoftening type colorant layer, a sublayer may be interposed to strengthen the adhesivity or stickiness of the thermosoftening type colorant layer to the support.

Such a sublayer as mentioned above can be formed normally with the conventional compositions used for an adhesive or a sticking agent.

As an example of such adhesives, a hot-melting adhesive may be given. It is a composition comprising a resin such as an ethylene-vinyl chloride copolymer, wax, plasticizer, tackifier, antioxidant, and fillers.

Therefore, as an example of compositions composing a sublayer, a composition comprising an ethylene-vinyl chloride copolymer, wax, plasticizer, tackifier, antioxidant, filler, and colorant may be given.

Besides, they include the compositions such as those composing a polyvinyl acetate emulsion type adhesive, those composing a chloroprene type adhesive, those composing an epoxy resin type adhesive, each can be used as the compositions for composing a sublayer.

The sticking agent includes, for example, natural rubber, chloroprene rubber, butyl rubber, polyacrylic acid esters, nitrile rubber, polysulfides, silicone rubber, SBR, Polyisoprene, Polyvinylether and Buna N.

The thickness of reclaimed rubber, such sublayer is within the range of, normally. 0.1 to 30 μm and, preferably. 0.3 to 10 μm.

The foregoing thermosoftening colorant layer contains binders and colorants.

As the binders, a heat-fusible substance, and a thermoplastic resin may be included as the examples.

The typical heat-fusible substances include, for example; vegitable wax such as carnauba wax, Japan wax, ouricury wax, and esparto wax:animal wax such as beeswax, insect wax, shellac wax, and whale wax; petroleum wax such as paraffin wax, microcrystal wax, Polyethylene wax, ester wax and acid wax; and mineral wax such as montan wax, ozokerite, and ceresin wax. Besides the above, they further include, for example, higher aliphatic acids such as palmitic acid, stearic acid, margaric acid, and behenic acid: higher alcohols such as palmityl alcohol, stearyl alcohol, behenyl alcohol, alcohol, miricyl alcohol, and eicosanol; higher aliphatic esters such as cetyl palmitate, mirisyl palmitate, cetyl stearate, and mirisyl stearate; amides such as acetamide, propionamide, palmitoamide, stearoamide, and amide wax; and higher amines such as stearyl amine, behenyl amine, and palmityl amine.

The thermoplastic resins include, for example, those of ethylene type copolymers, Polyacetals, polyamides, polyesters, polyurethanes, polyolefins, Polyacrylate, Poly vinyl chloride, celluloses, rosin, ionomer, and petroleum; elastomers such as natural rubber, styrene butadiene rubber, isoprene rubber, chloroprene rubber, and diene copolymers; rosin derivatives such as ester gum, rosin-maleic resin, rosin-phenol resin, and hydrogenated rosin resins such as phenol resin, terpene resin, cyclopentadiene resin, and aromatic hydrocarbon type resin; and these polymer compounds have a softening point of 50° to 200° C., softening point is measured by ring and ball method as described in JIS K2531.

By suitably selecting the foregoing heat-melting material and thermoplastic material, thermosoftening colorant layer having a desired thermosoftening point or heat-melting point can be prepared.

The colorants include, for example, pigments such as inorganic and organic pigments or dyes.

The inorganic pigments include, for example, titanium dioxide, carbon black, zinc oxide, Persian-blue, cadmium sulfide, iron oxide, and chromates of lead, zinc, barium, and calcium.

The organic pigments include, for example; those of an azo, thioindigo, anthraquinone, anthanthrone and triphenyl dioxazine; vat dyes/pigments; phthalocyanine pigments such as those of cupper phthalocyanine and the derivatives thereof; and quinacridone pigments.

The foregoing dyes include, for example, acid dyes, direct dyes, disperse dyes, oil-soluble dyes, and oil-soluble metal-containing dyes.

The colorant content of the thermosoftening colorant layer is within the range of, usually, 5 to 60% by weight and, preferably, 10 to 50% by weight.

For the above-mentioned thermosoftening colorant layer, the kinds of the binder and colorant, and the compounding amounts thereof, can be determined, provided, the thermosoftening colorant layer may have a self-supportability, and the heat-melting material and thermoplastic material may suitably be selected so as to satisfy the other required physical properties.

The thermosoftening colorant layer is also allowed to contain, besides the above-given components, the other additives such as a wax, surfactant, higher fatty acid derivative, higher aliphatic alcohol, higher aliphatic ether, phosphoric acid ester, and organic or inorganic filler.

When carbon black is selected to use as an inorganic material filler, a 'stone wall' structure is formed by the strong coagulation power of carbon black, and the colorant exuded, by being applied with heat, from the gaps of the 'stone wall' so as to be moved onto the surface of the support. On the other hand, when using alumina particles as an inorganic filler, colorants around the alumina particles are activated sooner by heating, so that the activated colorant moves to the support through between alumina particles by capillary phenomenon with the aid of a thermal expansion phenomenon produced with raising temperature of the colorant. In this way, a thermosoftening colorant layer having a special structure can be formed.

The thickness of the thermosoftening colorant layer can be within the range of, normally, 0.5 to 20 μm and, preferably, 1 to 10 μm so long as the thickness is adjusted so that the colorant layer may be peeled apart from the support and an heat energy may be applied with a well response from the thermosoftening colorant layer's side.

If required, a peeling layer of which will be detailed later may further be provided to improve the peeling property between the thermosoftening colorant layer and the support. It is also allowed to provide a sublayer, and a thermosoftening colorant layer in order onto the support.

Figure 8:
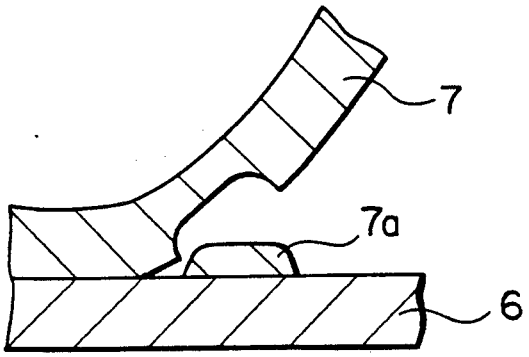
FIG. 8 is a cross-sectional illustration of the substantial functions of the recording material shown in FIG. 7.

Now, one of the example of the mechanism for being printed will be detailed. When heat-sensitive recording material 5 shown in FIG. 7 is heated imagewise from the side of thermosoftening colorant layer 7, for example, by making use of a heating means such as a thermal head, for example, the surface of support 6 adjoining to the heat melting coloring layer 7 becomes melting so that it becomes attached and mixed with the heat melting coloring layer 7, and the adhesion of thermosoftening colorant layer 7 to be heated and the support 6 becomes bigger than the adhesion of the thermosoftening colorant layer not to be heated and the support 6. So, if the thermosoftening colorant layer 7 and the support 6 are peeled off, thermosoftening colorant layer 7 to be heated is destroyed coagulatingly as shown in FIG. 8 so that at least a part of it *7a* attaches on the surface of the support 6 to remain. And the thermosoftening colorant layer 7 not to be heated is peeled off and does not remain on the surface of the support 6.

When the thermosoftening colorant layer is peeled off, image is formed by the remnants of the thermosoftening colorant layer to be heated and to be fixed on the surface of the support.

Figure 3:
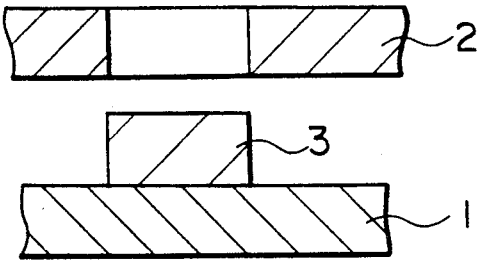

In the heat-sensitive recording material shown in FIG. 8, thermosoftening colorant layer is destroyed coagulatedly. But, by adjusting the component of thermosoftening colorant layer, an image can be formed by the surfactant peeling-off of the image as shown in FIG. 3.

In the recording material shown in FIG. 7, an anti-sticking layer (AST layer) can be provided additionally on the outer surface of the thermosoftening colorant layer. If this AST layer is provided, the attachment of thermosoftening material to the thermal head can be prevented when heat is drawn by the thermal head from the heat melting coloring layer side.

Anti-sticking layer is an preventing layer against the blocking phenomenon or sticking phenomenon.

As the anti-sticking layer, it is preferable to be formed by a conventional resin composition which can prevent the foregoing sticking phenomenon. For example, the composition, preferably, includes a resin composition containing (A) silicone type resin, (B) at least one selected from the group consisting of polyester resin, polyamido resin, cellulose type resin, acryl resin and flceoro containing resin and if necessary, (C) polyisocyanate compounds.

The silicone type resins may be represented by the following formula:

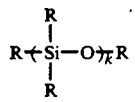

wherein R represents an organic group, k is an integer of not less than 1.

The resins preferably applicable include, for example, organopolysiloxyane, modified polysiloxyane resin, silicon modified acryl resin, silicon modified urethane resin, silicon modified urea resin, and silicone-modified epoxy resin. Such silicone modified resins are those prepared by modifying, for example, acryl resin, urethane resin, urea resin or epoxy resin by making use of polysiloxane.

In the above-mentioned various types of silicone-modified resins, the silicone contents thereof are within the range of, usually, 1 to 90% by weight and, prepferably, 5 to 50% by weight.

These silicone resins may be used independently or in combination.

Among these silicone resins, the above-given various silicone-modified resins are preferably used.

Such silicone resins are preferable to be hardened with a cross-linking agent.

The cross-linking agent includes, without special limitation, an isocyanate, an aziridine, and an epoxy, for example.

The silicone resin content of an anti-sticking layer is within the range of, normally, 1 to 100 wt % and, preferably, 10 to 80 wt %.

The silicone resins may be added in the form of a resin and they may also be contained uniformly in the hardened matter of a peeling layer. It is further allowed to contain them in the form of fine powder into the peeling layer.

There is no special limitation to the above-mentioned polyamide resins, provided, they are the so-called thermoplastic polyesters.

The polyamide resins include, without special limitation, Nylon 6, Nylon 8, Nylon 11, Nylon 66, and Nylon 610, for example. Besides the above, the copolymers thereof may also be used for.

The foregoing cellulose resins include, for example, those of cellulose esters such as acetyl cellulose, nitrocellulose, and acetylbutyl cellulose, cellulose ethers such as ethyl cellulose, methyl cellulose, bezyl cellulose, and carboxymethyl cellulose.

The foregoing acryl resins include, for example, the homopolymers of methyl acrylate, ethyl acrylate, methyl methacrylate, ethyl methacrylate, acrylonitrile, acrylamide, and the drivatives thereof, and copolymers of various kinds of acryl monomers with vinyl acetate, vinyl chloride, styrene, or anhydrous maleic acid.

The foregoing fluoro-containing resins include, for example, ethylene tetrafluoride resin, ethylene tetrafluoride-propylene hexafluoride copolymer resin, ethylene-tetrafluoride-perfluoroalkoxyethylene copolymer resin, ethylene trifluorochloride resin, ethylene tetrafluoride-ethylene copolymer, vinylidene fluoride resin, and vinyl fluoride resin.

Such fluoro-containing resins may be used independently or in combination.

The above-given various kinds of resins may be added in the form of a resin and they may also be contained uniformly in the hardened matter of an anti-sticking layer. It is further allowed to contain them in the form of fine powder into the anti-sticking layer.

The anti-sticking layer is also allowed to contain, for example, inorganic or organic fine particles such as those of fluororesin, metal powder, or silica gel, a surfactant, and a lubricant.

Such anti-sticking layer is further allowed to contain, besides the above-given components, additives such as a wax, a surfactant, a higher fatty acid derivative, a higher aliphatic alcohol, a higher aliphatic ether, and a phosphoric acid ester.

The compounding proportion of the components given above may suitably be determined to form such an anti-sticking layer as described above.

The anti-sticking layer is to be formed on the outermost layer of a heat-sensitive recording material, by adopting a coating method in which a solvent is used.

If the thickness of such an anti-sticking layer is not less than 0.01 μm, it would be good enough. However, it is practically within the range of 0.03 to 30 μm.

In the recording material shown in FIG. 7, when thermosoftening colorant layer 7 has either no or less self-supportability, it is allowed to provide the peelable support of which will be described later so as to assist the peelability. It is also allowed to give the above-mentioned anti-sticking property to a peelable support. It is further allowed to provide the anti-sticking layer onto the outer surface of either the peelable support or support 6.

Modification example 1

Figure 9:
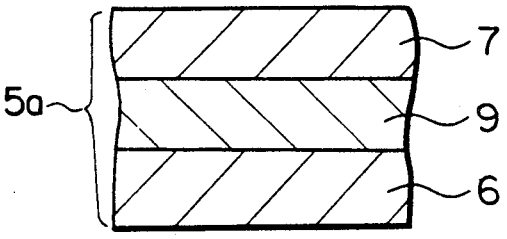
FIG. 9 is a cross-sectional illustration of another embodiment of the invention.

The heat-sensitive recording material shown in FIG. 9 is a modification example of the heat-sensitive recording material shown in FIG. 7.

In heat-sensitive recording material 5*a* shown in FIG. 9, thermosoftening layer 9 and thermosoftening colorant layer 7 were laminated in order on the surface of support 6.

The material of the above-described support is the same as that of the support of the heat-sensitive recording material shown in FIG. 7.

Thermosoftening layer 9 can be formed either by compounding the same binder as that used for forming the foregoing thermosoftening colorant layer, a stickifier or a thermomelting material, and a resin having a relatively low softening point or having a low glass-transition point Tg, which is selected from the group consisting of, for example, ethylene copolymers such as an ethylene-vinyl acetate copolymer and an ethylene-ethyl acrylate copolymer; polyamide resins; polyester resins; polyurethane resins; acryl resins; and vinyl chloride resins; or, by using a conventionally known pressure-sensitive stickifier.

Such stickifiers include, for example, a rosin stickifier; unmodified or modified rosin stickifiers such as a hydrogenated rosin stickifier, a rosin maleic acid stickifier, a polymeric rosin stickifier, and a rosin phenol stickifier; a terpene stickifier; a petroleum resin stickifier; and the modified stickifiers thereof.

The thermomelting materials applicable thereto include the same as those used in the foregoing thermosoftening colorant layer.

The thickness of the thermosoftening layer is within the range of, normally, 1 to 50 μm and, preferably, 1.5 to 10 μm.

Such thermosoftening layer is allowed to be colorless. If a ground-color is to be given to a recording image, it is preferable to contain, for example, a suitable colorant such as a white or light-colored pigment.

Figure 10:
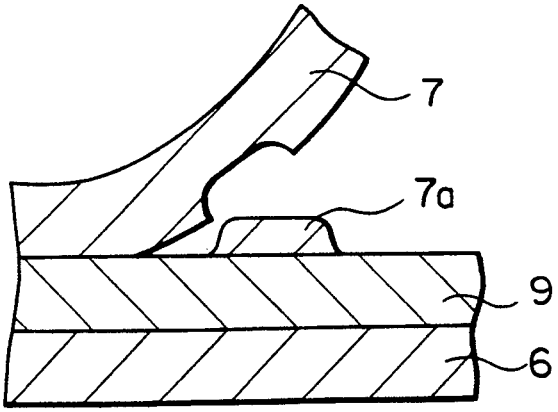
FIG. 10 is a cross-sectional illustration of the substantial functions of the recording material shown in FIG. 9.

In heat-sensitive recording material 5*a* shown in FIG. 9, thermosoftening layer 9 and support 6 are in a tightly adhered state in advance. Therefore, when applying heat imagewise from the side of support 6, for example, by making use of a thermal head, for example, heat-applied thermosoftening colorant layer 7 and thermosoftening layer 9 are thereby mixedly fused so that the fixability of two layers may be enhanced. When thermosoftening colorant layer 7 is peeled off after heat was applied, at least a part 7*a* of the heat-applied thermosoftening colorant layer 7 remains on the thermomelting sticky layer, as shown in FIG. 10.

In heat-sensitive recording material 5*a* shown in FIG. 9, it is also allowed to provide a further anti-sticking layer onto the outer surface of thermosoftening colorant layer 7. If this is the case and when applying heat from the thermosoftening colorant layer side through a thermal head, the adhesion of the colorant to the thermal head may be prevented.

In heat-sensitive recording material shown in FIG. 9, the thermosoftening colorant layer is also allowed to contain, for example, an anti-stickifier such as silicone resin, polyester resin, polyamide resin, cellulose resin, acryl resin, or a polyisocyanate compound. In this case, the thermosoftening colorant layer is formed as an anti-sticking thermosoftening colorant layer.

It is further allowed to provide a peelable support layer onto the thermosoftening colorant layer, i.e. onto the outer surface of the colorant layer. It is the matter of course that an anti-sticking layer may be provided, if required, onto the peelable support layer.

Such peelable support layer is so provided as to assist the thermosoftening colorant layer to be peeled off when the thermosoftening colorant layer has either no or less self-supportability.

Such peelable support layer may be formed by using, without special limitation, a thermoplastic resin, provided, the resin has a mechanical strength as much as the layer can be peeled off. Among these resins, those having a relatively high glass transition temperature Tg, such as, polyacrylate resins, cellulose resins, polycarbonate resins and polyparabanic acid resin, may preferably be used.

Figure 11:
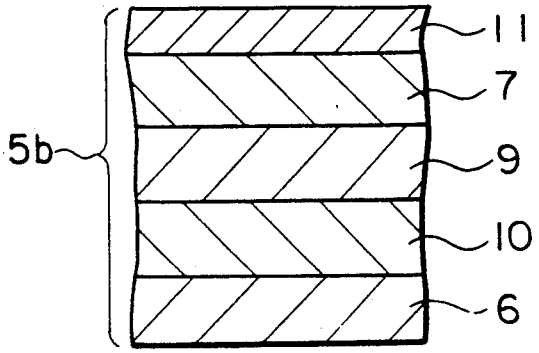
FIG. 11 is a cross-sectional illustration of a further embodiment of the invention.

In heat-sensitive recording material 5*b* shown in FIG. 11, peelable layer 10, thermosoftening layer 9, and thermosoftening colorant layer 7 are laminated in order on the surface of support 6. Similar to the recording material shown in FIG. 9, this recording material is allowed to have a peelable support layer and an anti-sticking layer, if required.

In this recording material, the support, thermosoftening layer, thermosoftening colorant layer, peelable support layer, and anti-sticking layer thereof are the same as those of the heat-sensitive recording materials shown in FIG. 7 and 9.

The peelable layer, which functions to smoothly peel a thermosoftening layer apart from a support, may be formed by compounding the same binder as that used for forming the above-described thermosoftening colorant layer or thermosoftening layer, and silicone resin. In this case, it is also allowed that a ground color may be given, if required, by adding a colorant.

The thickness of such a peelable layer is within the range of, normally, 0.1 to 10 μm and, preferably, 0.2 to 5 μm, so as not to hinder thermal response.

The peelable support layer described above is preferably provided on the colorant layer by a coating or laminating method. The coating method is more preferable, and the coating is carried out by using a solvent method or an emulsion method. The coating method includes te known techniques such as gravure-coater method, a wire-bar coating method, an air-knife coating method and a dip-coater method.

Figure 12:
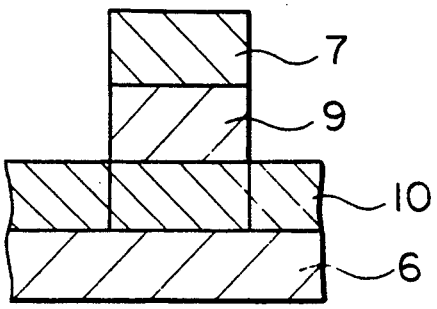
FIG. 12 is a cross-sectional illustration of the substantial functions of the recording material shown in FIG. 11.

Also in the heat-sensitive recording material shown in FIG. 11, when heat is applied thereto from the side of support 6 or thermosoftening colorant layer 7 through a thermal head, for example, heat-applied thermosoftening colorant layer 7, thermosoftening layer 9, and peelable layer 10 are mixedly fused to enhance the fixability among the layers. On the other hand, in the unheated portions of peelable layer 10, the peelability of peeling apart from thermosoftening layer 9 is greater and, in the heat-applied portions thereof, thermosoftening layer 9 and peelable layer 10 tightly adhere or stick to each other and, therefore, as shown in FIG. 12, heat-applied peelable layer 10, thermosoftening layer 9, and thermosoftening colorant layer *7a* each remain on the surface of support 6 after a peeling operation was completed, and thereby an image is formed.

In this case, the peeling operation may be readily performed, because peelable layer 10 is provided.

Further in heat-sensitive recording material shown in FIG. 11, peelable layer 10 and thermosoftening layer 9 may be replaced by each other. For example, one of the structures is that thermosoftening layer 9 is provided onto the surface of support 6 and peelable layer 10 is laminated on thermosoftening layer 9. In such a layer arrangement, thermosoftening layer 9 and peelable layer 10 are separated from each other on the interface therebetween. In this layer lamination arrangement, therefore, a ground color may be given to an image when thermosoftening layer 9 contains a colorant, as aforedescribed.

In each of the above-given examples, the heat-applied adhesion or sticking of a layer to the support, or the adhesion or sticking of a layer to a thermosoftening layer provided onto the support, is produced by meltingly adhering to or making miscible with each other layer upon application of thermal fusion. It is also allowed to use other adhesion or sticking mechanism.

It is further allowed to form an image in such a mechanism that a latex, which is capable of displaying a layer-making function and contained in advance in a thermosoftening colorant layer, is so changed as to be a thin layer by applying heat, and the thermosoftening colorant layer is made adherent to a support by the resulting thin layer.

Figure 13:
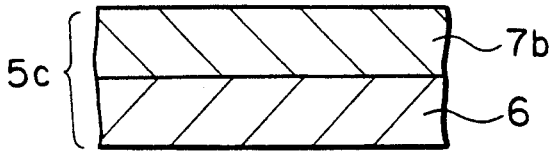
FIG. 13 is a cross-sectional illustration of a still further embodiment of the invention.
Figure 14:
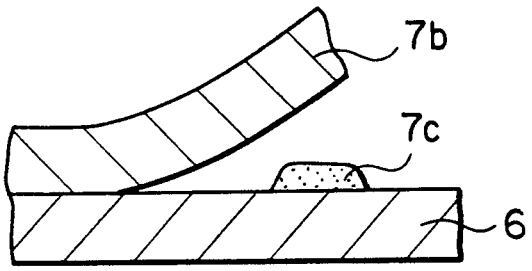
FIG. 14 is a cross-sectional illustration of the substantial functions of the recording material shown in FIG. 13.

In the case of heat-sensitive recording material 5*c* provided, onto the surface of support 6, with a lamination of specially structured thermosoftening colorant layer *7b* containing a colorant in the mesh-like or stone wall-like matrix thereof, colorant *7c* is oozed out of specially structured thermosoftening colorant layer *7b* by applying heat as shown in FIG. 13, and, when peeling specially structured thermosoftening colorant layer *7b* apart from support 6, oozed out colorant *7c* remains on the surface of support 6, so that an image may be formed.

It would further be better to provide appropriately the foregoing peelable layer, thermosoftening layer, peelable support layer, anti-sticking layer, and anti-fogging layer. Such peelable layer, thermosoftening layer, peelable support layer, and anti-sticking layer are similar to those used in the recording materials shown in FIGS. 7, 9, 11, and 12.

The purpose of providing an anti-fogging layer is to prevent the recorded image surface from staining when forming thermosoftening colorant layer *7b* on a printed record surface or in the course of storing the recorded image.

It is also allowed that such anti-fogging layer may or may not functions by itself as a peelable layer, and such anti-fogging layer may be formed by compounding, for example, a thermosoftening resin, a thermofusible material, a filler, and a lubricant such as silicone resin, fluororesin, and surfactant.

Such anti-fogging layer are so designed thin as not to hinder colorant *7c* from permeating therethrough. The thickness of the anti-fogging layer is within the range of, normally, 0.1 to 3 μm and, preferably, 0.2 to 1.0 μm.

In the above-described embodiments having various modification examples, various types of layers may be formed by adopting any of the coating techniques such as a reverse-roll coater method, an extrusion-coater method, a gravure-coater method, and a wire-bar coating method.

Embodiment 1 and the modification examples thereof are collectively shown in FIG. 15.

The second embodiment

A heat-sensitive recording material, that is the preferable embodiment Z of the invention, comprises a lamination of a mordant layer serving as the above-described image-receiving layer and a dye-supplying layer serving as the above-described colorant containing layer.

1. Basic constitution

Figure 16:
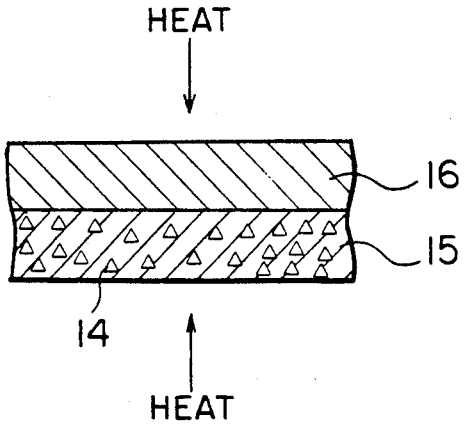
FIGS. 16, 17, 18, 19, 20, 21, 22, 23, 24, 25 and 26 are each the cross-sectional illustrations of the other embodiments of the invention.

The second embodiment is basically constituted by that, as shown in FIG. 16, a dye-supplying layer 15 containing a dye 14 and a mordant layer 16 are provided, through which, dye 14 of dye-supplying layer 15 is diffusively moved into the mordant layer 16 by applying heat energy from the side of the dye-supplying layer 15 or mordant layer 16 so that an image may be formed on the mordant layer 16 by the diffused dye 14, and the image-recorded mordant layer 16 is then separated from the dye-supplying layer 15. The separated mordant layer having the image thereon is used as an image recorded member by itself. The resulting image-recorded member functions as if it were, for example, an image-printed or image-drawn sheet of paper. Therefore, the mordant layer itself has not stickiness.

The dye-supplying layer contains a dye and a binder. In the dye-supplying layer, the dye is thermally diffused when applying heat energy.

The dye-supplying layer may have neither fusible adhesion property nor image-transfer property to the mordant layer, or the whole part of the dye-supplying layer may have either fusible adhesion property or image-transfer property.

There is no special limitation to the dyes, provided that they may be diffused by heat, changed to be thermally diffusible, sublimatable, vaporized, or thermally fusible.

In the meantime, the diffusibility of dye molecules is changed depending on the molecular weight thereof. Therefore, the molecular weight of the dye suitable for the invention is within the range of, normally, 50 to 4,000 and preferably, 100 to 1,000.

When the molecular weight of the dye is within the range of 100 to 1,000, the diffusibility of the dye becomes articularly preferable.

In this embodiment, the dye is diffusively moved into the mordant layer by applying heat. It is, therefore, preferable that the dye may readily be fused, sublimated, or vaporized by applying heat energy supplied from a thermal head.

The melting points, sublimating temperatures, or vaporizing temperatures each required for dyes are varied depending on what kind of recording apparatuses should be loaded with the above-mentioned heat-sensitive recording material and how to make a heat-sensitive record. Therefore, such preferable temperatures cannot absolutely be fixed. When using this type of heat-sensitive recording material with a facsimile communication apparatus, for example, the melting point, sublimating temperature, or vaporizing temperature for such dyes is within the range of, preferably, 60° to 300° C. and, more preferably, 100 to 250° C.

Such dyes may be made present in the dispersed, dissolved, or molecular-dispersed state in the binder of which will be described later.

Such dyes include, for example, leuco dyes, i.e., soluble vat dyes, direct dyes, acid dyes, basic dyes, acid mordant dyes, metal complex dyes, sulfur dyes, vat dyes, azoic dyes, disperse dyes, reactive dyes, oxidation dyes, and oil dyes.

In the invention, the above-given dyes may be used independently or in combination.

When two or more kinds of such dyes are used in combination and they are different from each other in tone, molecular weight, melting point, sublimating temperature, vaporizing temperature, and, therefore, in dispersion property, the tones and color density of an image can be controlled by suitably applying heat energy. For example, images such as multicolored or various color-density characters, drawings and marks may be formed on a mordant layer by applying suitable heat energy from an exothermic element.

The dye content of the whole dye-supplying layer is within the range of, normally, 5 to 80 wt % and, preferably, 10 to 50 wt %.

The amount of the dye to 100 parts by weight of the binder is used within the range of, normally, 5 to 300 parts by weight and, preferably, 10 to 200 parts by weight.

There is no special limitation to the above-described binders, provided that, when no heat is applied, they may be able to maintain such dyes stably, and that, when heat is applied, they may be softened or melted in themselves so as to make the dye movement ready.

Such binders include, for example, a thermoplastic resin, a thermofusible material, and a plasticizer.

The thermo plastic resins are similar to those having been described in the foregoing first embodiment.

Figure 17:
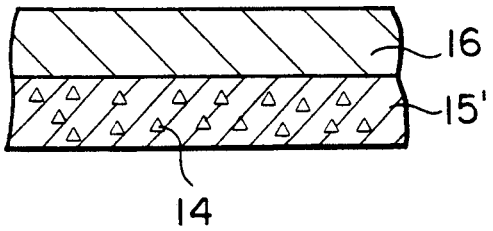

In this invention, various kinds of the thermoplastic resins may be used independently or in combination. Among these thermoplastic resins, if a thermoplastic resin itself may be formed into a film or sheet shape, it functions not only as a binder but also as a support. Therefore, when such a thermoplastic resin capable of being formed in itself in a film or sheet shape is served as a binder, the resulting dye-supplying layer has a self-supportability to become self-supportable dye-supplying layer 15', as shown in FIG. 17, so that any support should not particularly be required, and dye-supplying layer 15 and mordant layer 16 may readily be separated from each other.

The above-mentioned thermofusible materials are similar to those described in the foregoing first embodiment.

In this invention, various thermofusible materials may be used independently or in combination.

The plasticizers applicable to the invention may be selected, for example, from the group consisting of those of phthalic acid esters, phosphoric acid esters, adipic acid esters, sebacic acid esters, azelaic acid esters, citric acid esters, glycolic acid esters, trimellitic acid esters, phthalic acid isomer esters, polyesters, and epoxides.

The other plasticizers, besides the above, include, for example, those of fatty acid esters, fatty acids, silicone-oil, modified silicon-oil, fluorine-oil, and liquid paraffin.

The content of the above-described binders in the dye-supplying layer is within the range of, normally, 1 to 50 wt % and, preferably, 3 to 30 wt %.

If required, such dye-supplying layer is allowed to contain a thermal-dispersion aid, a filler, a pigment, an antioxidant, and UV-absorbent.

The layer thickness of such dye-supplying layer is within the range of, normally, 0.5 to 30 μm and, preferably, 1 to 10 μm.

Such dye-supplying layer may be formed on a mordant layer, directly or with the interposition of an interlayer.

If such dye-supplying layer itself has no self-supportability, it may be formed; on the support of which will be described layer, directly or with the interposition of the sublayer of which will be described layer; or on a mordant layer, directly or with the interposition of an interlayer; by adopting a coating method such as a hot-melt coating method, an aqueous coating method, or a coating method in which an organic solvent is used; or by laminating it on. If such dye-supplying layer has a self-supportability, it may be formed in the film or sheet shape in a extrusion moulding process.

2. The first modification example

Figure 18:
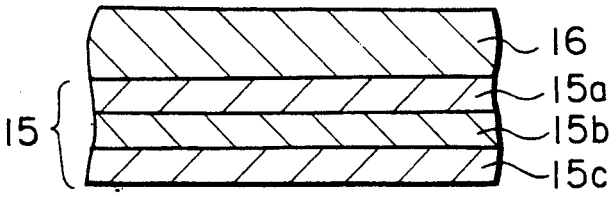

This dye-supplying layer may be either of the single-layered or of the multiple-layered as hown in FIG. 18.

In FIG. 18, dye-supplying layer 15 comprises three component layers, namely, a green dye-supplying component layer 15*a* supplying green dye, a red red-supplying component layer 15*b* supplying red dye, and a yellow dye-supplying component layer 15*c* supplying yellow dye. The thicknesses of these three dye-supplying component layers, 15*a*, 15*b*, and 15*c*, may not necessarily be made the same with each other, but may suitably be made different from each other so as to meet the kinds of such dyes, because the diffusion distance of such dyes may be considered to be the thicknesses of the dye-supplying layer.

In the case where dye-supplying layer 15 comprises the above-described three component layers, the color dyes are moved to a mordant layer according to the heat energy applied, respectively, so that a recorded member having a colored image thereon may be obtained.

Each of the three component layers constituting the above-described dye-supplying layer is allowed not only to be compounded with different tone dyes as described above, but also to contain the dyes having a different molecular weight, melting point, or sublimating temperature, respectively.

The three component layers of the dye-supplying layer may be of the self-supportable, as described above.

The mordant layer is a layer capable to forming an image thereon when it receives a dye being diffusively moved thereinto so as to be fixed by applying heat. The dye is fixed not only when the whole dye is diffused in the binder of the mordant layer so as to mordant the mordant layer, but also when the dye mordants the surface of the mordant layer.

The materials for forming the mordant layer include, for example, thermoplastic resins, thermofusible materials, and plasticizers, each of which is similar to the binders normally used in the foregoing dye-supplying layer.

The thermoplastic resins, thermofusible materials, and plasticizers are exemplified in the foregoing description, and a further detailed exemplification will be omitted here. In the mordant layer, however, dyes are desired to have a higher solubility or miscibility than in the dye-supplying layer.

The thermoplastic resins preferably applicable to the invention include, for example, polyester resins, vinyl chloride resins, vinylidene chloride resins, and urethane resins.

Among the thermoplastic resins, some of the resins can function not only as a mordant layer capable of receiving a dye, but also as a support, provided, such resins itself can be formed into the film or sheet shape.

Figure 19:
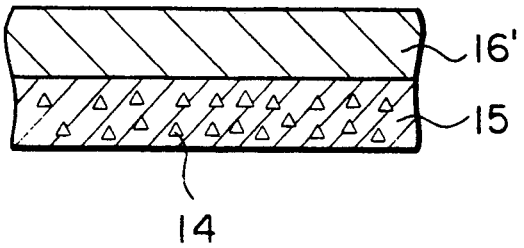

Therefore, as shown in FIG. 19, when mordant layer 16 is formed of a thermoplastic resin which can be formed into a film or sheet shape, such mordant layer can be self-supportable or can become a self-supporting mordant layer 16'. Therefore, any support may not particularly be necessary, and dye-suppling layer 15 and mordant layer 16 can readily be separated from each other. It is also possible to make both dye-supplying layer and mordant layer self-supportable.

Such mordant layer can be formed with at least one selected from the group consisting of the above-given thermoplastic resins, thermofusible materials, and plasticizers. The mordant layer is further allowed to contain a chelating agent, an antioxidant, a UV-absorbent, and a filler.

The fillers include, for example, silica, talc, calcium carbonate, alumina, acid clay, clay, magnesium carbonate, tin oxide, titanium white, graphite, setting resin particles, silicone resin particles, fluororesin particles, melamine resin particles, urea resin particles, benzoquanamine resin particles, acryl resin particles, styrene resin particles, boron nitride, copper, iron, aluminium, iron oxide, aluminium oxide, magnesium oxide, and titanium nitride. Besides the above-given fillers, there includes a colored filler. When compounding such colored filler into a mordant layer, the layer is ground-colored.

The mordant layer may be either colorless and transparent or ground-colored as mentioned above.

When the mordant layer is ground-colored, an image formed of a dye having a different color from the ground color may be distinctly displayed.

The mordant layer may be formed on a support either directly or with the interposition of an interlayer.

If such mordant layer itself has no self-supportability, the mordant layer may be formed; on the support directly or with the interposition of the sublayer of which will be described layer; or on a dye-supplying layer directly or with the interposition of an interlayer; by adopting a coating method such as a hot-melt coating method, an aqueous coating method, or a coating method in which an organic solvent is used; or by laminating it on. If such mordant layer has a self-supportability, it may be formed in the film or sheet shape in a extrusion moulding process.

3. The second modification example

Figure 20:
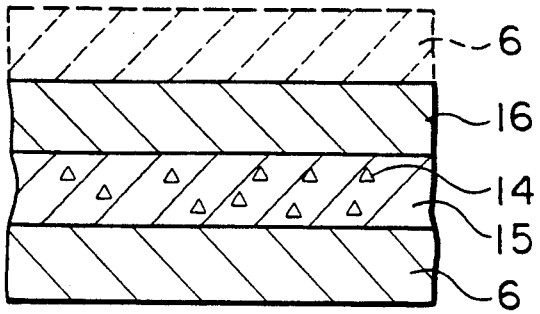

In this modification example of the second embodiment suitable for the invention, the heat-sensitive recording material comprises, as shown in FIG. 20, support 6 provided either to mordant layer 16 on the side opposite to dye-supplying layer 15 or to dye-supplying layer 15 on the side opposite to mordant layer 16; or, the recording material is comprised of one each of support 6 provided to both sides of mordant layer 16 and dye-supplying layer 15; so as to smooth the separation of mordant layer 16 from dye-supplying layer 15.

In this modification example, a support should be provided, because the self-supportability of the dye-supplying layer and/or the mordant layer each have not satisfactory mechanical strength for separating these layers from each other.

Such support is desired to have excellent heat resistance and dimensional stability. The materials for such support are as given before.

The support is also allowed to contain a colorant. When the support contains a colorant and the support and a mordant layer are directly adjacent to each other, the color of the support colored by the colorant will become the ground color to an image formed on the mordant layer so that the contrast of the image may be distinct.

Figure 21:
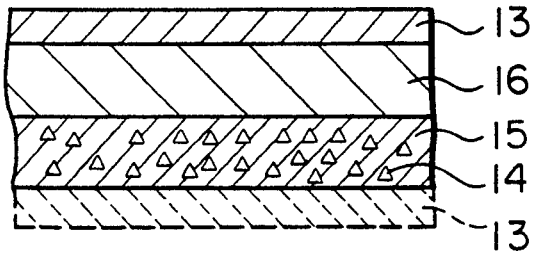
Figure 22A:
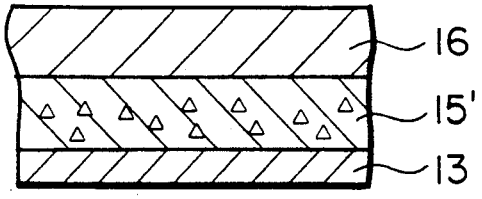
Figure 22B:
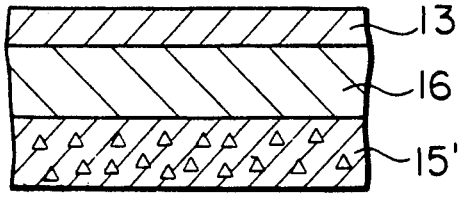
Figure 23:
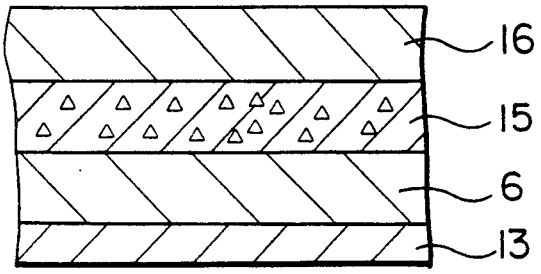

In the second embodiment of the invention, the heat-sensitive material basically has a dye-supplying layer, a mordant layer and, if required, a support, as aforedescribed. On the other hand, in the layer arrangement of the heat-sensitive recording material, it is allowed to form anti-sticking layer 13; on the surface of dye-supplying layer and/or mordant layer 16 which is the outermost layer, as shown in FIG. 21; on self-supportable dye-supplying layer 15' and/or self-supportable mordant layer 16' each of which is the outermost layer, as shown in FIG. 22(*a*) and 22(*b*); or, on the surface of support 6, as shown in FIG. 23.

In the above-described cases, the anti-sticking layer has the same functions or performance and may also be formed of the same compositions as those described in the foregoing first embodiment.

Figure 24:
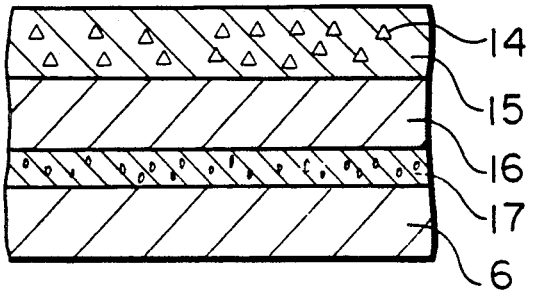

In the case of a heat-sensitive recording material having a mordant layer formed on a support, sublayer 17 may be interposed between support 6 and mordant layer 16 with the purposes of enhancing the adhesion of mordant layer 16 and support 6 to each other and producing a ground color to an image formed on mordant layer 16, as shown in FIG. 24.

When such sublayer for producing a ground color is provided, the contrast of the dye-image formed on mordant layer 16 can be made distinct.

For example, such a sublayer as described above may be formed by using a mixture of a known composition serving as an adhesive and a colorant.

The kinds of such adhesives are as aforedescribed.

The above-described colorants include, for example, inorganic and organic pigments.

Such inorganic pigments as described above include, for example, titanium oxide, carbon black, zinc oxide, Prussian blue, cadmium sulfide, iron oxide, and the chromates of lead, zinc, barium or calcium.

Such organic pigments as described above include, for example, those of the azo, thioindigo, anthraquinone, anthanthrone, and triphenyloxazine types, phthalocyanine pigments such as copper phthalocyanine and the derivatives thereof, and a quinacridone pigment.

The thickness of such a sublayer is within the range of, normally, 0.3 to 3 μm and, preferably, 0.5 to 2 μm.

Figure 25:
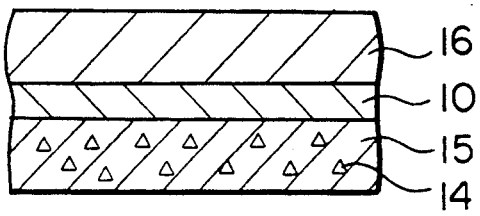

As shown in FIG. 25, it is also allowed to interpose peeling layer 10 as an interlayer between mordant layer 16 and dye-supplying layer 15, or between a self-supporting type mordant layer and a self-supporting type dye-supplying layer, because the interpostion of the peeling layer makes it smooth and easy to separate those two layers when it is interposed.

Figure 26:
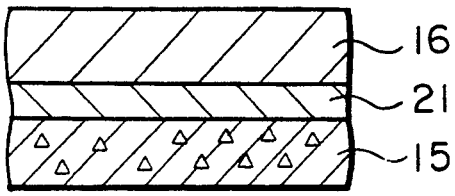

As shown in FIG. 26, it is further recommended to interpose anti-fogging layer 21 as an interlayer between mordant layer 16 and dye-supplying layer 15, or between a self-supporting type mordant layer and a self-supporting type dye-supplying layer. If the anti-fogging layer 21 is interposed, the mordant layer or the self-supporting type mordant layer can effectively be prevented from stains produced by the natural diffusion of dyes which may occur when forming the mordant layer on the dye-supplying layer or the self-supporting type dye-supplying layer, or when the resulting heat-sensitive material is stored for a long time.

The peeling layer and anti-fogging layer may be prepared by compounding, for example, a thermosoftening resin, a heat-melting substance, a filler, a lubricant, a releasing agent such as silicone resin, fluororesin, and surfactant.

The thicknesses of both peeling layer and anti-fogging layer are within the range of, normally, 0.3 to 3 μm and, preferably, 0.5 to 2 μm, and, the thinner, the better.

The above-described interlayer is also allowed to have a dual-layered structure in which one interlayer is arranged to the peeling layer and the other layer to the anti-fogging layer, or to have the functions of the peeling and anti-fogging layers.

Such heat-sensitive materials thus prepared can be used in the tape, sheet or the like form.

According to the heat-sensitive materials in the second and third embodiments, an image can be formed, for example, in the following manner.

By making use of a thermal head, heat pulses are applied to the heat-sensitive material from the side of the surface capable of being heated, and thereby the dye-supplying layer or the self-supporting type dye-supplying layer and the mordant layer or the self-supporting type mordant layer are heated locally corresponding to a desired original print or transferring pattern.

The heated areas of the dye-supplying layer and the mordant layer are rapidly melted by raising a temperature to diffusively transfer the dyes contained in the dye-supplying layer into the mordant layer, so that the image can be formed on the mordant layer. Then, when the dye-supplying layer is separated from the mordant layer, a recording medium having the image on the mordant layer can be obtained. The recording medium itself may be handled as if it were a paper on which the image was drawn. Therefore, the mordant layer itself has no stickiness.

FIG. 27 collectively illustrates both of the second embodiment and the modification example thereof.

The third embodiment

The heat-sensitive recording materials each relating to the third embodiment comprise a dye-supplying layer as a colorant layer, and either a sticky mordant layer or a mordant layer having a sticky layer on its side facing the dye-supplying layer; or, they comprise each a mordant layer as an image-receiving layer, and either a sticky dye-supplying layer or a dye-supplying layer having a sticky layer on the side facing the mordant layer, as the colorant layer.

The third embodiment of the heat-sensitive recording material is based on the following principle:

(a) From a layer having contained in advance a heat diffusible dye to the other layer, the dye is to be diffusively transferred by heat;

(b) The recipient layer of the dye transferred thereto by the heat-diffusion is to be separated from the other layer; and (c) The recipient layer of the dye, or the layer having contained in advance a heat-diffusible dye, is to be made sticky.

The heat-sensitive recording materials of the third embodiment based on the above-described principle can be modified variously.

1. The first Modification example

Figure 28:
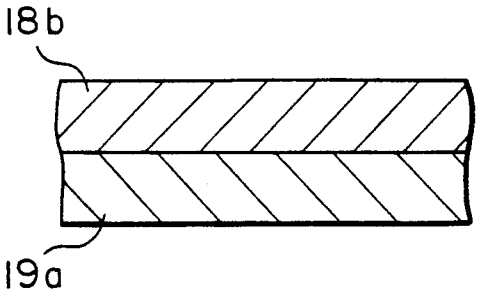
FIGS. 28, 29, 30, 31, 32, 33, 34, 35 and 36 are each the several alternative embodiments of the heat-sensitive materials of the invention.

As shown in FIG. 28, this modified heat-sensitive recording material is a laminate comprising sticky mordant layer **18*b* serving as both of a sticky layer and a mordant layer, and dye-supplying layer 19*a* containing heat-diffusible dye, each laminated together. The laminate is so prepared as to separate sticky mordant layer 18*b* from dye-supplying layer 19*a***.

The components, compositions and layer arrangements of the dye-supplying layer are the same as those of the dye-supplying layer described in the foregoing second embodiment.

The sticky mordant layer can be prepared by adding a sticking agent to the components of the mordant layer described in the foregoing second embodiment.

There is no special limitation to the sticking agents, but any one for general use may be used.

The typical examples of such sticking agents include, for example; natural rubber; those of the chloroprene, butyl rubber, polyacrylic acid ester, nitrile rubber, polysulfide, and silicone rubber types; and those prepared with reclaimed rubber, SBR, polyisoprene, polybutyl ether, and Buna-N.

Among the above-given examples, more preferable ones are natural rubber, chloroprene rubber, butyl rubber, and Polyacrylates.

Such stcking agents are further allowed to contain suitably a tackifier, a plasticizer, a filler, an age resistor.

The tackifiers include, for example, polyterpene resin, gum rosin, rosin derivatives, oil-soluble phenol resin, cumarone indene resin, cumarone resin, indene resin, and petroleum hydrocarbon resin.

The plasticizers include, for example, mineral oil, liquefied polybutene, liquid polyacrylate, and lanolin.

The fillers include, for example, zinc white, hydrate aluminium, titanium oxide, calcium carbonate, clay, pigment, silica, and aluminium hydroxide.

The age resistors include, for example, di-thiocarbamate, a metal chelating agent, and antioxidant.

The content of the sticking agent in a sticky mordant layer may not always be fixedly determined, because it depend on the kinds of the components of the sticky mordant layer and the content thereof, and the kinds of adhesives used. To sum up, the content thereof may be suitably determined so that a sticky mordant layer may easily be peeled off from a dye-supplying layer, and that the sticking agent may be able to display a stickiness or adhesive strength of the order that the sticky mordant layer may easily be pasted up on the other member. Normally, the content of the sticking agent of the sticky mordant layer is within the range of 1 to 90 wt %.

In the heat-sensitive recording material of the first modification example, when applying heat energy from the dye-supplying layer side or the sticky mordant layer side, dyes are diffusively transferred from the dye-supplying layer into the sticky mordant layer and an image is then formed on the sticky mordant layer. When the sticky mordant layer is separated from the dye-supplying layer, the sticky mordant layer having an image formed thereon can be obtained, because the dye-supplying layer and the sticky mordant layer are so laminated as to be separated from each other. The sticky mordant layer having the image formed thereon is handled as an independent recorded medium having the image formed thereon. The image formed on the recorded medium is excellent in image storage stability, because it is formed on the independent recorded medium.

The image-formed mordant layer can be pasted up as a label on other articles.

Further, if a sticky mordant layer is separated from a dye-supplying layer and is then pasted up on another dye-supplying layer separately prepared, another new heat-sensitive recording material can be prepared. If the new material is applied with heat energy again, another image can be superposed on the sticky mordant layer having the image formed thereon. If the kind of the dye contained in the dye-supplying layer separately prepared is changed into the different kind of the dye from that contained in the dye-supplying layer used before separating the sticky mordant layer, the images each formed superpositively on the sticky mordant layer may be multicolored or may have the different color tone.

2. The second modification example

Figure 29:
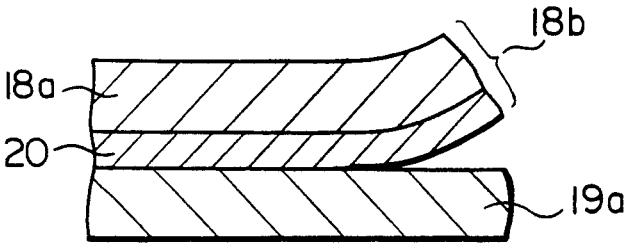

As shown in FIG. 29, this modified heat-sensitive recording material is a laminate comprising; non-sticky mordant layer 18*a* which forms an image upon receipt of a dye being diffusively transferred thereto: dye-supplying layer 19*a* which contains a dye being diffusively transferred by applying heat energy; sticky layer 20 which is interposed between layer 18*a* and layer 19*a*; and sticky layer-attached mordant layer 18*b* which can be separated from dye-supplying layer 19*a*; each of which are laminated.

The non-sticky mordant layer and the dye-supplying layer are the same as the mordant layer described in the foregoing second embodiment.

Such sticky layer is arranged when both of the mordant layer and the dye-supplying layer are either non-sticky or less sticky. Nevertheless, it is allowed to arrange a sticky layer even if the mordant layer is a sticky mordant layer or the dye-supplying layer is a sticky dye-supplying layer.

Such sticky layer is so prepared as to have a stickiness to a dye-supplying layer. As shown in FIG. 29, the reason why the sticky layer should be prepared as described above is that sticky layer attached-mordant layer 18*b* is made it possible to separate from dye-supplying layer 19*a*, namely, the separation of the sticky layer from the dye-supplying layer.

A sticky layer can be separated from a dye-supplying layer, but not from a mordant layer, by suitably adjusting the compositions of the sticky layer components, taking the compositions of the dye-supplying layer and the mordant layer into consideration. As will be described later, if a peeling layer is interposed between the sticky layer and a layer which may be separated from the sticky layer, a sticky layer attached-mordant layer can readily be separated.

In either way, the above-described sticky layer can be prepared of a tackifier which is the same as those for the aforedescribed sticky mordant layer.

The thickness of such a sticky layer described above is within the range of, usually, 0.3 to 500 μm and, preferably, 0.5 to 50 μm.

In the heat-sensitive recording material shown in FIG. 29, an image is formed on the mordant layer by applying heat energy, and the mordant layer having the image formed thereon is separated from a dye-supplying layer. To be more accurate, in the heat-sensitive material, the mordant layer united with a sticky layer in a body is separated from the dye-supplying layer.

The mordant layer thus separated and made independent still has a sticky layer, therefore, the sticky layer-attached mordant layer has the equal or similar functions to those of the sticky mordant layer of the first modification example, so that it may be handled as a label and may be utilized as a mordant layer having thereon a multicolored or different color-tone image.

3. The third modification example

TM The heat-sensitive recording material of Modification Example 3 is a laminate comprising; a dye-supplying layer containing a dye which is diffusively transferred by applying heat energy: a sticky layer; and a mordant layer forming an image upon receipt to the dye diffusively transferred from the dye-supplying layer; wherein the layers are laminated in the above order, and the mordant layer and the sticky layer-attached dye-supplying layer can be separated apart.

Figure 30:
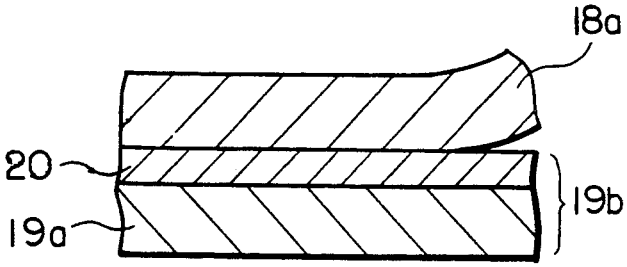

To be more concrete, in the heat-sensitive recording material, as shown in FIG. 30 each of the layers are laminated so that sticky layer 20 may be interposed between non-sticky mordant layer 18*a* and dye-supplying layer 19*a*, and mordant layer 18*a* and sticky layer-attached dye-supplying layer 19*b* may be separated apart.

While the sticky layer may be peeled apart from the mordant layer, it still stickily adheres to the dye-supplying layer. Such sticky adhesion thereof may be obtained by controlling each component of the tackifier so as to meet the compositions of the mordant layer and dye-supplying layer.

The thickness of the sticky layer is as same as that in the second modification example.

As is same as in the first and second modification examples, in this example also, an image may be formed on a mordant layer by applying heat energy, and the mordant layer having the image thereon may be separated from a sticky layer-having dye-supplying layer.

Similar to the case of the first modification example, this mordant layer is handled as an independent image-recorded medium. The image formed on the recorded medium is excellent in image-storage stability, because the image is formed on the independent medium.

When a separate and independent mordant layer having an image thereon is attached to another separately prepared and sticky layer attached dye-supplying layer, a further new heat-sensitive recording material can be prepared. When applying heat energy again to the newly prepared heat-sensitive recording material, another image can be superposed upon the mordant layer having the image thereon. If the dye of this separately prepared sticky layer attached dye-supplying layer is made different from the dye of the sticky layer attached dye-supplying layer which did not yet separate the mordant layer therefrom, the image superposed on the mordant layer can be multicolored or made it to have the other tone than the original tone.

4. The fourth modification example

The heat-sensitive recording material of this modification example comprises a sticky dye-supplying layer containing a dye diffusively moved by applying heat energy thereto, and a mordant layer forming an image thereon upon receipt of the dye diffusively moved thereto so that the sticky dye-supplying layer and the mordant layer can be separated from each other.

Figure 31:
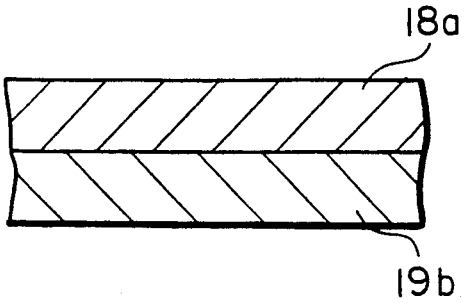

To be more concrete, such heat-sensitive recording materials include, as shown in FIG. 31, a laminated member comprising non-sticky mordant layer 18*a* and sticky dye-supplying layer 19*b* which also serves as a sticky layer and contains a thermodiffusible dye.

Such mordant layer as described above is similar to that detailed in the foregoing first embodiment.

Such sticky dye-supplying layer can be prepared by adding a stickifier to the composition of preparing the dye-supplying layer detailed in the foregoing second embodiment. Of the stickifiers, the description has already been made in the foregoing first modification example.

In the heat-sensitive recording material of this fourth modification example, the sticky dye-supplying layer thereof can function as same as that of the aforedescribed sticky layer attached dye-supplying layer, and displays the same or equivalent functional effects as in the third modification example.

5. Layer arrangement

The heat-sensitive recording material relating to the third embodiment basically comprises, as shown in the foregoing first to fourth modification examples, a sticky mordant layer and a dye-supplying layer, a sticky layer attached mordant layer and a dye-supplying layer, a mordant layer and a sticky layer attached dye-supplying layer, or a mordant layer and a sticky dye-supplying layer.

Figure 32:
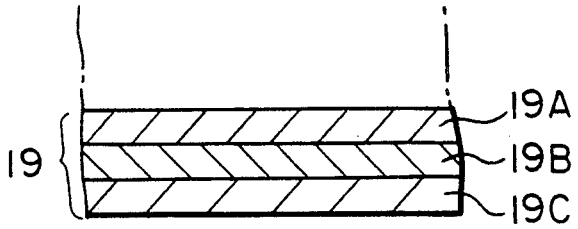

In such a layer arrangement as mentioned above, the dye-supplying layer is not limitative to have a single-layer arrangement, but is allowed to have a plural-layer arrangement such as a three-layer arrangement,—Refer to FIG. 32.—

In FIG. 32, dye-supplying layer 19 comprises, for example, the following three component layers, namely, green dye-supplying layer 19A containing green dyes, a red dye-supplying layer 19B containing red dyes, and yellow dye-supplying layer 19C containing yellow dyes. The thicknesses of these three dye-supplying layers may not necessarily be the same, but may be so variable appropriately to meet the kinds of the dyes.

In the case of such three-layered dye-supplying layer, each color-forming dye moves into the mordant layer according to heat energy applied, so that a recording medium having a color-image thereon can be obtained.

Each component layer of such three-layered dye-suppling layer is allowed not only to be compounded with dyes each different in tone as described above, but also to contain the dyes each different in molecular weight, melting point or sublimating temperature.

Such three-layered dye-supplying layer may be of self-supportable, or, among the three component layers, at least one on the mordant layer side may have a stickiness.

In the above-described basic constitution, the dye-supplying layer and mordant layer are so made self-supportable as to readily peel apart the dye-supplying layer from the mordant layer. To make the dye-supplying layer and mordant layer self-supportable, each of the layers is preferable to use therein a binder capable of forming the recording material into the film or sheet shape.

When the dye-supplying layer and mordant layer are not self-supportable, it is preferable to provide a support.

Figure 33:
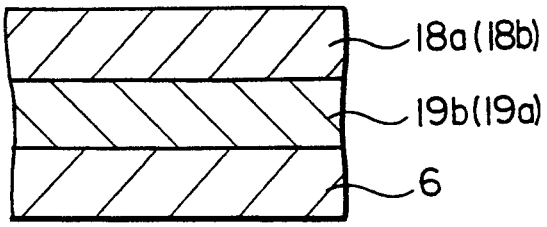

To be more concrete, as shown in FIG. 33, it is preferable to provide the support to dye-supplying layer 19*a* or sticky dye-supplying layer 19*b* on the side thereof opposite to sticky mordant layer 18*b* or mordant layer 18*a*. When laminating the support onto the dye-supplying layer or the sticky dye-supplying layer, the mechanical strength of the dye-supplying layer or the sticky dye-supplying layer may be enhanced, as well as the sticky mordant layer or the mordant layer may smoothly be peeled apart from the sticky dye-supplying layer or the dye-supplying layer, According to the material of the invention, a transparent support is preferably provided on the outer surface of the image receiving layer.

Figure 34:
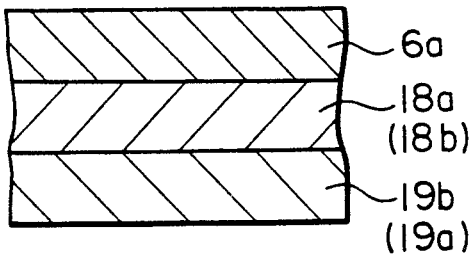

As shown in FIG. 34, it is preferable to provide transparent support 6*a* onto mordant layer 18*a* or sticky mordant layer 18*b* on the side thereof opposite to sticky dye-supplying layer 19*b* or dye-supplying layer 19*a*. When providing the transparent support, not only the same effects as those of the above-described support can be displayed, but also the surface of the image-formed mordant layer can be protected when the separated mordant layer is so pasted as to serve as a label over the other material or article.

In other words, when the above-described transparent support is provided to the above-described mordant layer on the side thereof opposite to the dye-supplying layer, or it is provided to the sticky mordant layer on the side thereof opposite to the dye-supplying layer, not only the mordant layer or the sticky mordant layer can readily be separated, but also the image formed on the mordant layer or the sticky mordant layer can be prevented from being scratched or rubbed, because the transparent support is provided onto the surface of the mordant layer or the sticky mordant layer pasted over the other article, and such transparent support can serve as a surface protective layer.

It is also preferable to provide a transparent support onto the surface of a mordant layer or a sticky mordant layer and, at the same time, to provide a support onto the surface of a sticky dye-supplying layer or a dye-supplying layer.

In either way, it is preferable that such support including the transparent support should have excellent heat resistance and dimensional stability.

The composing materials of such supports are the same as those described in the foregoing first embodiment of the invention.

A support having a clearness may be used as the transparent support. The wording, 'clearness' herein means a transparency of the order that an image on a mordant layer can at least be recognized.

The thicknesses of such supports including the above-described transparent support are not specially limitative, but any thicknesses may be selected. However, the thickness thereof is, normally, not thicker than 30 μm and, preferably, within the range of 2 to 30 μm.

For example, it is also preferable to interpose a peelable layer 10 (not shown); between sticky mordant layer 18*b* and dye-supplying layer 19*a*, as shown in FIG. 28; between sticky layer 20 and dye-supplying layer 19*a*, as shown in FIG. 29; between sticky layer 20 and mordant layer 18*a*, as shown in FIG. 30; or between mordant layer 18*a* and sticky dye-supplying layer 19*b*, as shown in FIG. 31.

When the above-described peelable layer is provided, the peeling force of a mordant layer or a sticky mordant layer from a sticky dye-supplying layer or a dye-supplying layer and vice versa may be so adjusted as to improve the peelability.

The above-described peelable layer is similar to those described in the foregoing first embodiment of the invention. For example, such a peelable layer may be formed of silicone resin, silicone-modified resin, wax, or a surfactant.

The thickness of the peelable layer is within the range of, normally, 0.1 to 10 μm and, preferably, 0.2 to 5 μm.

Figure 35:
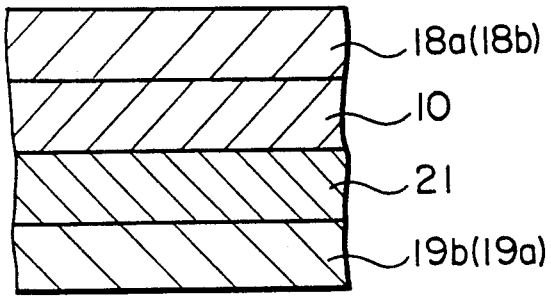

In the heat-sensitive recording material, it is preferable to interpose anti-fogging layer 21 as an interlayer between mordant layer 18*a* or sticky mordant layer 18*b* and sticky dye-supplying layer 19*b* or dye-supplying layer 19*a*, as shown in FIG. 35. In FIG. 35, numeral 10 indicates a peelable layer.

When the above-described anti-fogging layer is interposed between the mordant layer and the dye-supplying layer, it can effectively prevent the mordant layer or the sticky mordant layer from being stained by the natural diffusion of dyes caused either when forming the mordant layer or the sticky mordant layer on the sticky dye-supplying layer or the dye-supplying layer, or when the heat-sensitive recording material is being stored for a long time.

The above-described anti-fogging layer may usually be formed of the same binder as that used in the dye-supplying layer and an anti-foggant.

The anti-foggant may be prepared by making use of the aforedescribed thermoplastic resin, thermofusible material, and filler.

The thickness of the anti-fogging layer is within the range of, normally, 0.3 to 10 μm and, preferably, 0.5 to 5 μm.

When such an anti-fogging layer is interposed between a peelable layer and a dye-supplying layer, or between a mordant layer and a peelable layer, it can effectively prevent the mordant layer from fogging phenomenon produced by the dyes moved from the dye-supplying layer in the course of manufacturing or coating a heat-sensitive recording material or during the storage of the recording material.

When trying to simplify the layer arrangement so as to eliminate the complication of specially providing an anti-fogging layer, it is preferable to compound the anti-foggant into the peelable layer.

When the peelable layer contains the antifoggant, it can effectively prevent the mordant layer from a fogging phenomenon produced by the dyes moved from the dye-supplying layer in the course of manufacturing or coating the heat-sensitive recording material, or during the storage thereof.

In the heat-sensitive recording material, it is preferable to form an antisticking layer on the outer surface of at least one of the outermost layers of the layer arrangemenet.

Figure 36:
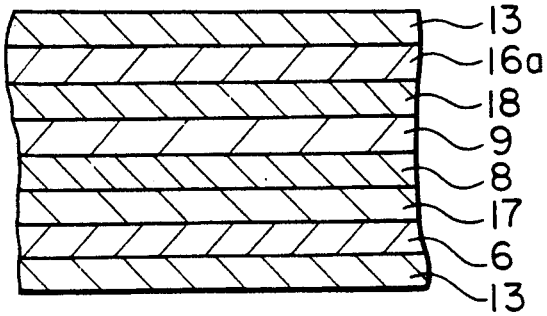

For example, as shown in FIG. 36, antisticking layer 13 may be formed on the surface of support 6 and/or a transparent support.

When the mordant layer or sticky mordant layer contains a non-diffusible colorant, or when arranging a non-diffusible colorant layer containing a non-diffusible colorant onto the surface of the dye-supplying layer or the sticky dye-supplying layer, the mordant layer or the sticky mordant layer is provided with ground-color by the above-mentioned non-diffusible colorant, so that a higher contrast may be produced between the ground-color and an image formed by the dyes moved from the dye-supplying layer or the sticky dye-supplying layer. Therefore, the resulting image can be displayed more sharper and clearer.

6. Application of the heat-sensitive recording material

The heat-sensitive recording material thus prepared may be used in the form of tapes or sheets, for example.

When using such a heat-sensitive recording material as mentioned above, an image may be formed in the following manner, for example:

Heat pulses are applied by using a thermal head to the heat-sensitive recording maerial from the heat-applicable side thereof so as to locally heat a dye-supplying layer or a sticky dye-supplying layer and a sticky mordant layer or a mordant layer each corresponding to a desired printed character of pattern which is to be transferred.

The temperatures of the locally heated portions of the dye-supplying layer or sticky dye-supplying layer and the sticky mordant layer or mordant layer are raised so that the locally heated portions thereof may be quickly melted, and the dyes contained in the dye-supplying laye or sticky dye-supplying layer are thereby diffusively moved to the sticky mordant layer or mordant layer so as to form the image on the sticky mordant layer or mordant layer. When separating the dye-supplying layer or sticky dye-supplying layer and the sticky mordant layer or mordant layer from each other, a medium having the image recorded on the sticky mordant layer or mordant layer thereof can be obtained.

In the case that the image-recorded medium obtained above is a sticky mordant layer or a sticky-layer attached mordant layer, the medium can also serve as a label when it is pasted upon the surface of other material or article.

In the meantime, the above-described recorded medium having the image is superposed on the other separately prepared dye-supplying layer having contained in advance other dyes of the different kind or tone from those of the dye having been contained in the dye-supplying layer used first, As in the preceding procedures, heat pulses are applied by a thermal head to this newly prepared heat-sensitive recording material from the heat-applicable side thereof, and the newly formed image may be superposed on the sticky mordant layer or sticky-layer attached mordant layer having already had the image thereon. The above-described procedures may be repeated any times.

Upon completion of the procedures, a recording material having a multicolored or different tone image on the sticky mordant layer or the sticky-layer attached mordant layer can be prepared. The resulting recording material can also serve as a label, as described above.

As shown in FIG. 31, in the case that the heat-sensitive recording material is a laminate member comprising sticky dye-supplying layer 19*b* and mordant layer 18*a* each laminated together, heat energy is applied to the mordant layer so as to form a certain image thereon and the mordant layer is then peeled apart from the recording material. The mordant layer thus peeled apart is then superposed on the other separately prepared sticky dye-supplying layer having contained in advance the dyes of the different kind or tone from those of the dyes contained in the sticky dye-supplying layer used first,.

As in the preceding procedures, heat pulses are applied by a thermal head to this newly prepared heat-sensitive recording material from the heat-applicable side thereof, and the newly formed image may be superposed on the mordant layer having already had the image thereon. The above-described procedures may be repeated any times.

Upon completion of the procedures, a mordant layer having a multicolored or different tone image thereon can be prepared. The resulting mordant layer can serve as an independent recording medium, as described above.

FIG. 37 collectively illustrates both of the third embodiment of the invention and the embodiment of the modification example thereof.

EXAMPLES

The invention will be further detailed with reference to the following examples.

Example 1

1. Formation of a thermosoftening layer

A coating solution prepared by dispersing the following thermosofening layer compositions into water was coated onto a smooth-surfaced paper sheet having a Beck's surface-smoothness of 200 seconds, and the resulting layer was dried up so as to complete a thermosoftening layer. The thickness of the layer is 10 g/m$^2$.

| Compositions of the thermosoftening layer | |
|---|---|
| Paraffin wax | 20 wt % |
| Polyester polymer, (having a weight-average molecular weight Mw = 20,000) | 40 wt % |
| Titanium oxide | 40 wt % |

2. Formation of a thermosoftening colorant layer

A coating solution containing the following thermosoftening colorant layer compositions was coated in an amount of 3 g/m$^2$ onto the thermosoftening layer prepared in the manner described in the preceding paragraph 1, so that a thermosoftening colorant layer was formed.

| Compositions of thermosoftening colorant layer | |
|---|---|
| Paraffin wax emulsion (as the solids) | 60 wt % |
| A dispersion of carbon black/water | 20 wt % |
| Acryl latex | 20 wt % |

3. Formation of anti-sticking layer

A coating solution containing the following anti-sticking layer compositions was coated in a thickness of 6 g/m$^2$ onto the thermosoftening layer prepared in the manner described in the preceding paragraph 2, so that an anti-sticking layer was formed.

| Compositions of anti-sticking layer | |
|---|---|
| Acryl latex | 8 wt parts |
| A dispersion of urethane/silicone/water | 1 wt part |
| A dispersion of aromatic polyester polymer/water | 1 wt part |

4. Formation of image

By making use of a thermal printer loaded with a 260 mm width line-head, and having an applicable energy capacity of 25 mj/mm$^2$ and a pressure capacity of 7 kg/head, a heat-energy was applied, from the anti-sticking layer side, to the heat-sensitive recording material prepared in the processes described in the preceding paragraphs 1 through 3, so that an image was formed.

As the results thereof, the thermosoftening layer and the thermosoftening colorant layer were peeled off from each other, so as to obtain an image formed by the thermosoftening colorant layer remaining imagewise on the thermosoftening layer.

The thermosoftening layer and the thermosoftening colorant layer were peeled off at an angle of 60°.

Example 2

A heat-sensitive recording material was prepared in the same manner as in Example 1, except that a peeling layer was so formed as to have a coated thickness of 0.5 μm, between a thermosoftening layer and a thermosoftening colorant layer, by coating the following composition:

| Peeling layer composition | |
|---|---|
| Paraffin wax | 80 wt % |
| Polyoxyethylene stearyl ether | 20 wt % |

When an image was formed by applying heat energy from the anti-sticking layer side in the same manner as in Example 1-(4), the thermosoftening layer and the thermosoftening colorant layer were readily peeled apart from between the interface thereof, and the peeling layer and the thermosoftening colorant layer were mixedly fused imagewise on the thermosoftening layer so that an image was produced.

Example 3

A heat-sensitive recording material was prepared in the same manner as in Example 1, except that a peeling support layer containing 100% of polycarbonate resin was so formed as to have a thickness of 6 μm, between a thermosoftening colorant layer and an anti-sticking layer.

Example 4

A heat-sensitive recording material was prepared in the same manner as in Example 2, except that a peeling support layer having the following composition was so formed as to have a thickness of 6 μm, between a thermosoftening colorant layer and an anti-sticking layer.

| Peeling support layer composition | |
|---|---|
| Nitrocellulose resin | 95 wt % |
| Ethylene-vinyl acetate copolymer resin | 5 wt % |

By making use of the heat-sensitive recording materials prepared in Examples 3 and 4, the images were formed in the same manner as in Example 1-(4), respectively, When the resulting recording materials of Examples 3 and 4 were each peeled apart at the peeling angle of 60°, the images remained imagewise on the thermosoftening layers.

Example 5

A coating solution containing the following thermosoftening colorant layer composition was so coated as to have a coated thickness of 3 g/m$^2$, in the same manner as in Example 1, on a flat and smooth sheet of paper formed thereon a thersoftening layer.

| Thermosoftening colorant layer composition | |
|---|---|
| Vinyl chloride-vinyl acetate copolymer | 40 wt % |
| Stearic acid | 40 wt % |
| Nigrosine | 10 wt % |
| Carbon black | 10 wt % |

When an image was printed on the resulting recording material in the same manner as in Example 1, the colorant oozed out of the colorant layer remained imagewaise on the thermosoftening layer.

Example 6

A sample was prepared in the same manner as in Example 5, except that a peeling and anti-fogging layer was arranged by coating the following composition:

The thickness of the anti-fogging layer was 0.5 μm,

| Peeling and anti-fogging layer composition | |
|---|---|
| Polyparabanic acid | 80 wt % |
| Stearic acid | 20 wt % |

An image was then formed imagewise in the same manner as in Example 5 with the above-mentioned exception.

Example 7

A sample was prepared in quite the same manner as in Example 6, except that the following peeling support layer composition was so coated as to have a coated thickness of 6 μm between a thermosoftening colorant layer and an anti-sticking layer.

| Peeling support layer composition | |
|---|---|
| Methyl cellulose | 80 wt % |
| An aqueous dispersion of ethylene-vinyl acetate copolymer | 20 wt % |

An image was then formed imagewise in the same manner as in Examples 5 and 6.

Example 8

By making use of a 50 μ-thick vinyl chloride resin sheet as a self-supporting type mordant layer, a 6 μm dye-supplying layer comprising the following dye-supplying layer composition was formed on the self-supporting type mordant layer.

On the dye-supplying layer, a 0.3 μm-thick anti-sticking layer comprising the following anti-sticking layer forming resin was formed and, thus, a heat-sensitive recording material was obtained so that the self-supporting type mordant layer and the dye-supplying layer may be peeled apart from each other.

| Dye-supplying layer composition | |
|---|---|
| Nitrocellulose resin | 70 wt % |
| Dye, MS Cyan VP | 30 wt % |
| Anti-sticking layer forming resin | |
| Silicone-modified urethane resin | 100 wt % |

By making use of a thermal head, heat energy was applied to the resulting heat-sensitive recording material so as to give a printed image. When the self-supporting type mordant layer and the dye-supplying layer were then peeled apart, a sharp and clear printed image was formed on the mordant layer.

Example 9

Onto a 8-μm thick polyethyleneterephthalate film support, a 10-μm thick sticky mordant layer comprising the following sticky mordant layer compositions was formed. And, onto the sticky mordant layer, a 2-μm thick peeling-property-having dye-supplying layer comprising the following dye-supplying layer compositions was formed. Then, onto the dye-supplying layer, a 0.3-μm thick anti-sticking layer comprising the following anti-sticking layer forming resin was formed. Thus, a heat-sensitive recording material which was capable of separating the sticky mordant layer from the dye-supplying layer was prepared.

| Sticky mordant layer composition | |
|---|---|
| This composition consisted of the polymers compounded of the following monomers: | |
| Vinyl chloride | 50 wt % |
| Vinyl acetate | 10 wt % |
| Octyl acrylate | 30 wt % |
| Ethyl acrylate | 5 wt % |
| Anhydrous maleic acid | 5 wt % |
| Dye-supplying layer composition | |
| Nitrocellulose resin | 30 wt % |
| Silicone-modified acryl resin | 20 wt % |
| Dye, Kayaset Blue 714 | 30 wt % |
| Silicone resin, polysiloxane resin | 20 wt % |
| Anti-sticking layer forming resin | |
| Silicone-modified acryl resin | 100 wt % |

To the resulting heat-sensitive recording material, heat energy was applied by a thermal head so that a printed image was formed on the sticky mordant layer.

After heat energy was applied and when the sticky modant layer was then separated from the dye-supplying layer, the sticky mordant layer was so formed as to have a sharp and clear printed image. The sticky mordant layer is also allowed to use as a label.

Example 10

On to a 50 μm-thick vinyl chloride resin sheet serving as a self-supporting type mordant layer, a 0.8 μm-thick sticky layer comprising the following sticky layer composition was formed; onto the sticky layer, a 3 μm-thick dye-supplying layer comprising the following dye-supplying layer composition was formed; and a 0.3 μm-thick anti-sticking layer comprising the following anti-sticking layer composition was formed; so that a heat-sensitive recording material of which the sticky layer-attached self-supporting type mordant layer and the dye-supplying layer may be peeled apart from each other could be obtained.

| Sticky layer composition | |
|---|---|
| The composition consisted of the copolymers compounded of the following monomers: | |
| 2-ethyl hexyl | 50 wt % |
| Vinyl acetate | 30 wt % |
| N-tert-butyl acrylate | 20 wt % |
| Dye-supplying layer composition | |
| Polyvinyl acetal resin | 70 wt % |
| Dye, MS Yellow VP | 30 wt % |
| Anti-sticking layer forming resin | |
| Silicone-modified urethane resin | 100 wt % |

A printed image was formed on the self-supporting type mordant layer by applying heat energy by a thermal head to the resulting heat-sensitive recording material, After heat energy was applied and when the sticky layer attached self-supporting type mordant layer and the dye-supplying layer were then peeled apart from each other, the sticky layer attached self-supporting type mordant layer was formed with a sharp and clear printed image. The sticky layer attached self-supporting type mordant layer can also serve as a label.

Example 11

Onto the surface of a 20-μm thick paper sheet serving as a support, vinyl chloride resin dissolved in a solvent was coated in a thickness of 10 μm so as to serve as a mordant layer. And, onto the surface of the mordant layer, a dye layer comprising nitrocellulose of 80% and Kayaset-Blue-14 dye of 20% dissolved in a solvent was coated in a thickness of 2 μm. Then, onto the surface of the dye layer, polysiloxane resin of 100% was coated to serve as an anti-sticking layer to be in thickness of 0.5 μm. Thus, a heat-sensitive recording material was prepared, To the resulting heat-sensitive recording material, heat energy of 40 mj/head was applied imagewise from the anti-sticking layer side by a serial head.

When the heat energy was applied and the dye layer was then peeled apart from the mordant layer, a beautiful, high-density image was formed on the mordant layer.

Example 12

Onto one side of a 3.5 μm-thick polyethyleneterephthalate film support, a 0.1 μm-thick anti-sticking layer comprising silicone-modified urethane resin dissolved in a solvent was coated. And, onto the other side of the support, a 1 μm-thick mordant layer comprising polyester resin dissolved in a solvent was formed. Then, onto the surface of the mordant layer, a 0.5 μm-thick interlayer, i.e., a peeling-antifogging layer, comprising paraffin wax of 80% and polyoxyethylene stearyl ether of 20% each dissolved in a solvent was coated. Further, onto the surface of the inter layer, a 3 μm-thick dye layer comprising Polyrinylbutyral of 70% and dye, i.e., MS Magenta-VP, of 30% each dissolved in a solvent was coated. Thus, a heat-sensitive recording material was prepared.

By making use of a line head, heat energy was applied imagewise to the resulting heat-sensitive recording material from the anti-sticking layer side.

When the heat energy was applied and the mordant layer and the dye layer were then separated from each other, a sharp and clear image was formed on the mordant layer.

Advantages of the Invention

According to this invention, a support having an image formed thereon can be served for an image-recorded member as it is, because the support and a thermosoftening colorant layer are united in a body, and the support and the thermosoftening colorant layer can be separated from each other after heating imagewise. It is, therefore, possible to provide a nobel recording material which does not require any conventional ink-ribbon independent from a recording-member, and eliminates complicated operations such as a heat-application to the superposition of an ink-ribbon upon a recording-member.

Also, according to the second embidiment of this invention, it is possible to obtain a recording material formed thereon a multicolored image or an image having various tones, because of the following facts:

1. The storage stability of a printed image is excellent, because an image-receiving layer and a dye-supplying layer are independent from each other;

2. Image printing can be performed simply and efficiently, because every image formation is not required to use two component materials such as a medium to be recorded and a heat-sensitive recording medium, but is required only one component material; and 3. After printing an image, a mordant layer or a sticky mordant layer is separated from the side of a sticky dye-supplying layer or a dye layer and the separated mordant layer or the sticky mordant layer is superposed upon a sticky dye-supplying layer or a dye-supplying layer separately prepared, so that another heat-sensitive recording material can be newly prepared and, upon applying heat to the newly prepared recording material, an image-formed mordant or sticky mordant layer is superposed on the recording material to produce another new image, so that a recording material having a multicolored image or various tone image thereon can be obtained as the result.

Such mordant layers having a sticking property including a sticky layer attached mordant layer and a sticky mordant layer may also be well-served as a label.

When it is used as a label as mentioned above, the label is excellent in abrasion resistance, image storage and cost saving.

Further, according to the third embodiment of this invention, a heat-sensitive image-transfer type image-recording medium having the following advantages can be provided:

1. The printed image storage stability is excellent, because there uses no colorant which is color developable by applying heat, but uses a dye which is stable against heat, though the dye is diffusively moved by applying heat; and 2. Image printing can simply and efficiently be performed, because there utilizes no chemical reaction type color developing mechanism, but utilizes an image forming mechanism in which a dye is diffusively moved by applying heat.

What is claimed is:

1. A method of forming a heat sensitive recording material composed of a colorant layer comprising a binder and a colorant peelably adhered to an image receiving layer, wherein a peeling force necessary to peel said colorant layer from said image receiving layer is 0.1 to 1000 g/mm at an angle of 180°, and with which an image is formed by applying heat to a surface of said colorant layer in a pattern corresponding to an image being formed whereby heated portions of said colorant layer are non-peelably adhered to said image receiving layer, a non-heated portion of said colorant layer being peeled from said image receiving layer, said method comprising;

preparing a coating solution comprising said binder and said colorant, coating said coating solution onto said image receiving layer, and drying the coated solution to form said colorant layer, wherein said colorant comprises at least one material selected from the group consisting of organic pigments, inorganic pigments and dyes and said binder comprises at least one heat-fusible substance selected from the group consisting of vegetable wax, animal wax, petroleum wax, mineral wax, higher aliphatic acids, higher alcohols, higher aliphatic esters, and higher amines, at least one thermoplastic resin selected from the group consisting of polyacetals, polyamides, polyesters, polyurethanes, polyacrylates, polyvinyl chloride, cellulose, rosin, ionomers, natural rubber, styrene-butadiene rubber, isoprene rubber, chloroprene rubber, ester gum, rosin-maleic resin, rosin-phenol resin, hydrogenated rosin, phenol resin, terpene resin, cyclopentadiene resin, and mixtures thereof.

2. The method of claim 1, wherein the thickness of said support is 1 to 500 μm.

3. The method of claim 1, wherein a sublayer containing an adhesive is provided between said image receiving layer and said colorant layer.

4. The method of claim 3, wherein the thickness of said sublayer is 0.1 to 30 μm.

5. The method of claim 1, wherein the colorant content of said thermosoftening colorant layer is within the range of 5 to 60% by weight.

6. The method of claim 1, wherein the thickness of thermosoftening colorant layer is within the range of 0.5 to 20 μm.

7. The method of claim 1, wherein an antisticking layer is provided on a surface of the thermosoftening colorant layer furthest from said image receiving layer.

8. The method of claim 7, wherein the antisticking layer contains silicone resins.

9. The method of claim 8, wherein the silicone resin content of the antisticking layer is within the range of 1 to 100% by weight.

10. The method of claim 7, wherein the thickness of the antisticking layer is 0.03 to 30 μm.

11. The method of claim 1, wherein said image receiving layer is a mordant layer and said colorant layer is a dye-supplying layer.

12. The method of claim 11, wherein said colorant layer contains a thermally diffusing dye.

13. The method of claim 12, wherein said dye has a molecular weight of from 50 to 4000.

14. The method of claim 1, wherein melting point, sublimation temperature or vaporizing temperature of said dye is within the range of 60° to 300° C.

15. The method of claim 1, wherein the dye content of said colorant layer is within the range of 5 to 80% by weight.

16. The method of claim 1, wherein the thickness of the dye-supplying layer is 0.5 to 30 μm.

17. The method of claim 1, wherein said image receiving layer contains a sticking agent.

18. The method of claim 1, wherein said colorant layer contains a sticking agent.

19. The method of claim 1, wherein a sticking layer containing a sticking agent is provided between said image receiving layer and said colorant layer.

20. The method of claim 19, wherein said sticking agent is at least one material selected from the group consisting of natural rubber, chloroprene rubber, butyl rubber and polyacrylates.

21. The method of claim 1, wherein a transparent layer is provided on surface of the image receiving layer furthest from said colorant layer.

22. The method of claim 1, wherein a peelable layer containing at least one material selected from the group consisting of silicone resin, wax and a surfactant is provided between said image receiving layer and said colorant layer.

23. The method of claim 22, wherein the thickness of said peelable layer is 0.1 to 10 μm.

24. The method of claim 1, wherein an anti-fogging layer containing at least one material selected from the group consisting of a thermoplastic resin, and a filler is provided between said image receiving layer and said colorant layer.

25. The method of claim 24, wherein the thickness of said anti-fogging layer is 0.3 to 10 μm.

26. The method of claim 1, an image receiving layer and a colorant layer has a peelable layer provided on a surface of the colorant layer furthest from said image receiving layer.

27. The method of claim 26, wherein the material has an interlayer is provided between the image receiving layer and the colorant layer.

28. The method of claim 26, wherein said peelable support layer is composed of at least one material selected from polyacrylate resins, cellulose resins, polycarbonate resins, and polyparabanic acid resin.

29. The method of claim 1 wherein said thermoplastic resin is a diene copolymer.

30. The method of claim 1 wherein said thermoplastic resin is a polyolefin.

31. The method of claim 1 wherein said binder comprises a thermoplastic resin.

32. The method of claim 31 wherein said thermoplastic resin has a softening point of 50° to 200° C.

33. The method of claim 1 wherein an antifogging layer containing at least one material selected from the group consisting of a heat-fusible substance and a filler is provided between said image receiving layer and said colorant layer.

* * * * *